US009791832B2

(12) United States Patent
Hiraya

(10) Patent No.: US 9,791,832 B2
(45) Date of Patent: Oct. 17, 2017

(54) TIMEPIECE AND METHOD FOR MANUFACTURING TIMEPIECE

(71) Applicant: SEIKO EPSON CORPORATION, Tokyo (JP)

(72) Inventor: Eiichi Hiraya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 55 days.

(21) Appl. No.: 15/086,502

(22) Filed: Mar. 31, 2016

(65) Prior Publication Data

US 2016/0313698 A1 Oct. 27, 2016

(30) Foreign Application Priority Data

Apr. 22, 2015 (JP) ..... 2015-087810

(51) Int. Cl.

| | |
|---|---|
| ***G04B 19/25*** | (2006.01) |
| ***G04B 27/00*** | (2006.01) |
| ***G04B 27/04*** | (2006.01) |
| ***G04B 27/06*** | (2006.01) |
| ***G04B 27/02*** | (2006.01) |
| *G04B 19/00* | (2006.01) |

(52) U.S. Cl.

CPC ..... *G04B 19/25* (2013.01); *G04B 27/00* (2013.01); *G04B 27/001* (2013.01); *G04B 27/02* (2013.01); *G04B 27/045* (2013.01); *G04B 27/06* (2013.01); *G04B 27/065* (2013.01); *G04B 19/00* (2013.01)

(58) Field of Classification Search

CPC ..... G04B 19/00; G04B 19/25; G04B 27/00; G04B 27/001; G04B 27/02; G04B 27/045; G04B 27/06; G04B 27/065

See application file for complete search history.

(56) References Cited

U.S. PATENT DOCUMENTS

| | | | | | |
|---|---|---|---|---|---|
| 101,881 | A * | 4/1870 | Jacot | G04B 27/06 | 368/197 |
| 1,032,289 | A * | 7/1912 | Leslie | G04B 27/065 | 368/199 |
| 3,114,237 | A * | 12/1963 | Polo | G04B 27/06 | 368/197 |
| 3,470,687 | A * | 10/1969 | Noriyuki | G04B 19/25 | 368/32 |

(Continued)

FOREIGN PATENT DOCUMENTS

JP 2011-145163 A 7/2011

*Primary Examiner* — Amy Cohen Johnson
*Assistant Examiner* — Daniel Wicklund
(74) *Attorney, Agent, or Firm* — Global IP Counselors, LLP

(57) ABSTRACT

A timepiece includes a winding stem, a calendar correction transfer wheel that rotates in synchronization with the winding stem in a state in which the winding stem is pulled to a first-step position, a calendar corrector wheel that rotates in synchronization with the calendar correction transfer wheel, a setting wheel lever that supports the calendar correction transfer wheel and the calendar corrector wheel, and a date indicator that rotates in synchronization with the calendar corrector wheel. The setting wheel lever is provided with shaft receiving holes to which the calendar corrector wheel is attachable in a rotatable manner, and the calendar corrector wheel is attached to one of the shaft receiving holes in accordance with the type of the date indicator.

7 Claims, 12 Drawing Sheets

(56) References Cited

U.S. PATENT DOCUMENTS

| | | | | | |
|---|---|---|---|---|---|
| 3,645,090 | A * | 2/1972 | Mochizuki | G04B 19/25 | 368/32 |
| 3,775,966 | A * | 12/1973 | Matsuura | G04B 19/25 | 368/32 |
| 3,892,067 | A * | 7/1975 | Meylan-Piguet | G04B 19/25 | 368/36 |
| 3,983,691 | A * | 10/1976 | Schaller | G04B 19/25 | 368/31 |
| 4,109,458 | A * | 8/1978 | Suzuki | G04B 19/25 | 368/35 |
| 6,295,249 | B1 * | 9/2001 | Takahashi | G04B 27/06 | 368/190 |
| 2014/0056112 | A1 * | 2/2014 | Villaret | F16H 57/021 | 368/33 |
| 2015/0331392 | A1 * | 11/2015 | Ruefenacht | G04B 19/25 | 368/185 |
| 2016/0124388 | A1 * | 5/2016 | Neboisa | G04B 27/026 | 368/190 |

* cited by examiner

TIMEPIECE AND METHOD FOR MANUFACTURING TIMEPIECE

BACKGROUND

1. Technical Field

The present invention relates to a timepiece having a calendar display function and a method for manufacturing the timepiece.

2. Related Art

There is a timepiece of related art that allows a user to rotate a pulled-out crown to rotate the date indicator for date correction (see JP-A-2011-145163, for example).

In the timepiece described in JP-A-2011-145163, when the crown pulled out by one step is rotated, a first calendar corrector wheel, a second calendar corrector wheel, a third calendar corrector wheel, and a fourth calendar corrector wheel rotate in synchronization with each other, and a date indicator (first-digit date indicator) that engages with the fourth calendar corrector wheel rotates.

In the field of wristwatches, for example, to manufacture differently designed timepieces, timepieces in which the date indicators are sized and positioned differently are manufactured in some cases. To size and position the date indicator differently, a calendar corrector mechanism and other portions need to be designed in an exclusive manner, and it is required to manufacture timepieces in which the date indicators are sized and positioned differently with a small-scale design change.

SUMMARY

An advantage of some aspects of the invention is to provide a timepiece that allows manufacture of timepieces including different types of calendar wheel with a small-scale design change and a method for manufacturing the timepiece.

A timepiece according to an aspect of the invention includes a winding stem that is allowed to be pulled out to a first position in an axial direction of the winding stem, a calendar correction transfer wheel that rotates in synchronization with the winding stem in a state in which the winding stem is pulled out to the first position, a calendar corrector wheel that rotates in synchronization with the calendar correction transfer wheel, a setting wheel lever that supports the calendar correction transfer wheel and the calendar corrector wheel, and a calendar wheel that rotates in synchronization with the calendar corrector wheel. The setting wheel lever is provided with a first attachment section and a second attachment section to which the calendar corrector wheel is attachable in a rotatable manner, and the calendar corrector wheel is attached to one of the first attachment section and the second attachment section in accordance with a type of the calendar wheel.

The calendar wheel is, for example, a date indicator, and the type of the calendar wheel varies in terms of size, direction of rotation, and other factors.

The calendar corrector wheel attached to the first attachment section and the calendar corrector wheel attached to the second attachment section may be the same or different from each other in terms of the number of teeth and size.

The first attachment section is so provided that when a calendar wheel of one type is assembled in the timepiece, the calendar wheel rotates in synchronization with the calendar corrector wheel attached to the first attachment section. The second attachment section is so provided that when a calendar wheel of another type is assembled in the timepiece, the calendar wheel rotates in synchronization with the calendar corrector wheel attached to the second attachment section.

In the configuration described above, when the calendar wheel of the one type is assembled, the calendar corrector wheel is attached to the first attachment section, whereas when the calendar wheel of the other type is assembled, the calendar corrector wheel is attached to the second attachment section, whereby timepieces having calendar wheels of different types can be manufactured with a small-scale design change.

In the timepiece according to the aspect of the invention, it is preferable that the first attachment section and the second attachment are so provided as to sandwich the calendar correction transfer wheel, formed along an arc concentric with the calendar correction transfer wheel, and each formed of an elongated hole having one end along the arc closer to the calendar wheel than another end of the elongated hole, and that the calendar corrector wheel, when attached to the first attachment section, moves in a direction toward the calendar wheel along the elongated hole as the first attachment section and engages with the calendar wheel when the calendar correction transfer wheel rotates in a first direction so as to rotate the calendar wheel in a second direction that is opposite the first direction, and moves in a direction away from the calendar wheel along the elongated hole as the first attachment section and separates from the calendar wheel when the calendar correction transfer wheel rotates in the second direction, whereas when attached to the second attachment section, moves in the direction toward the calendar wheel along the elongated hole as the second attachment section and engages with the calendar wheel when the calendar correction transfer wheel rotates in the second direction so as to rotate the calendar wheel in the first direction, and moves in the direction away from the calendar wheel along the elongated hole as the second attachment section and separates from the calendar wheel when the calendar correction transfer wheel rotates in the first direction.

A drive direction in which the calendar wheel is driven and rotated by a drive mechanism provided in the timepiece is set to be the same as the direction in which the calendar wheel driven by the calendar corrector wheel rotates. That is, when the calendar corrector wheel is attached to the first attachment section, the drive direction is set to be the second direction, whereas when the calendar corrector wheel is attached to the second attachment section, the drive direction is set to be the first direction.

According to the aspect of the invention, in the case where the calendar corrector wheel is attached to the first attachment section, when the winding stem is rotated to rotate the calendar correction transfer wheel in the first direction, the calendar wheel rotates in the second direction, whereas when the winding stem is rotated to rotate the calendar correction transfer wheel in the second direction, the calendar wheel does not rotate.

On the other hand, in the case where the calendar corrector wheel is attached to the second attachment section, when the winding stem is rotated to rotate the calendar correction transfer wheel in the second direction, the calendar wheel rotates in the first direction, whereas when the winding stem is rotated to rotate the calendar correction transfer wheel in the first direction, the calendar wheel does not rotate.

The rotation of the winding stem therefore does not cause the calendar wheel to rotate in the direction opposite the drive direction, whereby a situation in which the calendar wheel drive mechanism is broken can be avoided.

According to the aspect of the invention, in which one of the first attachment section and the second attachment section is chosen and the calendar corrector wheel is attached to the chosen attachment section, timepieces in which the calendar wheels rotate in different directions can be manufactured with a small-scale design change.

It is preferable that the timepiece according to the aspect of the invention further includes a day corrector wheel engageable with the calendar corrector wheel and a day indicator that rotates in synchronization with the day corrector wheel, the calendar corrector wheel is attached to the first attachment section, and when the calendar correction transfer wheel rotates in the second direction, the calendar corrector wheel moves in the direction away from the calendar wheel along the elongated hole as the first attachment section and engages with the day corrector wheel.

According to the aspect of the invention, rotating the winding stem pulled out to the first position to rotate the calendar correction transfer wheel in the first direction allows the calendar wheel to rotate, for example, for date correction. Further, rotating the winding stem pulled out to the first position to rotate the calendar correction transfer wheel in the second direction allows the day indicator to rotate for day correction.

Since the day and date are corrected at the same time in many cases, the correction operability can be improved because both the date and day can be corrected in the state in which the winding stem is pulled out to the first position.

It is preferable that the timepiece according to the aspect of the invention further includes a clutch wheel that rotates integrally with the winding stem, a setting wheel that is supported by the setting wheel lever and rotates in synchronization with the clutch wheel and integrally with the calendar correction transfer wheel, and a minute wheel engageable with the setting wheel, the winding stem is allowed to be pulled out to a second position in the axial direction of the winding stem, that the setting wheel lever includes a swing shaft along a thickness direction of the timepiece, swings around the swing shaft in synchronization with the axial movement of the winding stem, and is located in a first movement position when the winding stem is pulled out to the first position, whereas located in a second movement position when the winding stem is pulled out to the second position, and that when the setting wheel lever is located in the first movement position, the calendar corrector wheel is engageable with the calendar wheel, and the setting wheel is separate from the minute wheel, whereas when the setting wheel lever is located in the second movement position, the calendar corrector wheel is separate from the calendar wheel, and the setting wheel engages with the minute wheel.

According to the aspect of the invention, rotating the winding stem pulled out to the first position allows rotation of the calendar wheel, for example, for date correction. Further, rotating the winding stem pulled out to the second position allows rotation of the minute wheel. For example, since an hour hand attachment shaft and a minute hand attachment shaft rotate in synchronization with the minute wheel, rotating the minute wheel allows rotation of the hour hand and the minute hand for displayed time correction.

In the timepiece according to the aspect of the invention, it is preferable that the swing shaft of the setting wheel lever interests a straight line passing through an axis of the winding stem at right angles, is positioned between a first vertical line that passes through an axis of rotation of the setting wheel in the case where the setting wheel lever is located in the first movement position and a second vertical line that intersects the straight line passing through the axis of the winding stem at right angles and passes through the axis of rotation of the setting wheel in the case where the setting wheel lever is located in the second movement position, and is located in a position where the swing shaft overlaps with the calendar wheel.

According to the aspect of the invention, in which the swing shaft of the setting wheel lever is located between the first vertical line and the second vertical line, the axis around which the setting wheel rotates when the setting wheel lever is located in the first movement position and the axis around which the setting wheel rotates when the setting wheel lever is located in the second movement position can be set on the straight line passing through the axis of the winding stem.

The clutch wheel, the setting wheel, and the minute wheel can therefore be arranged along the straight line described above, whereby the clutch wheel, the setting wheel, and the minute wheel are allowed to engage with each other in a well-balanced manner.

Further, in the aspect of the invention, since the swing shaft of the setting wheel lever is provided in a position where it overlaps with the calendar wheel, the distances from the swing shaft to the first attachment section and the second attachment section can be longer than in a case where the swing shaft is provided inside the inner circumference of the calendar wheel. Therefore, even when one of the first attachment section and the second attachment section is provided in positions shifted toward the swing shaft with respect to the calendar correction transfer wheel, the calendar corrector wheel attached to the attachment section provided in the position shifted toward the swing shaft is allowed to travel by a predetermined length when the winding stem is pulled out from the first position to the second position for separation between the calendar corrector wheel and the calendar wheel.

In the timepiece according to the aspect of the invention, it is preferable that the type of the calendar wheel includes a first calendar wheel and a second calendar wheel different from each other in terms of size, and that when the timepiece includes the first calendar wheel, the calendar corrector wheel corresponding to the first calendar wheel is attached to the first attachment section, whereas when the timepiece includes the second calendar wheel, the calendar corrector wheel corresponding to the second calendar wheel is attached to the second attachment section.

According to the aspect of the invention, timepieces in which the calendar wheels have different sizes can be manufactured with a small-scale design change.

Another aspect of the invention relates to a method for manufacturing a timepiece including a winding stem that is allowed to be pulled out to a first position in an axial direction of the winding stem, a calendar correction transfer wheel that rotates in synchronization with the winding stem in a state in which the winding stem is pulled out to the first position, a calendar corrector wheel that rotates in synchronization with the calendar correction transfer wheel, a setting wheel lever that supports the calendar corrector wheel, and a calendar wheel that rotates in synchronization with the calendar corrector wheel, the setting wheel lever provided with a first attachment section and a second attachment section to which the calendar corrector wheel is attachable in a rotatable manner, the method including attaching the calendar corrector wheel to one of the first attachment section and the second attachment section in accordance with a type of the calendar wheel.

According to the timepiece manufacturing method according to the aspect of the invention, the same advantageous effects as those provided by the timepiece according to the aspect of the invention described above can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

In an embodiment of the invention, two timepieces, a timepiece 1 and a timepiece 1A, will be described. The timepiece 1 and the timepiece 1A differ from each other in terms of the size and position of the date indicator.

Configuration of Timepiece 1

Figure 1:
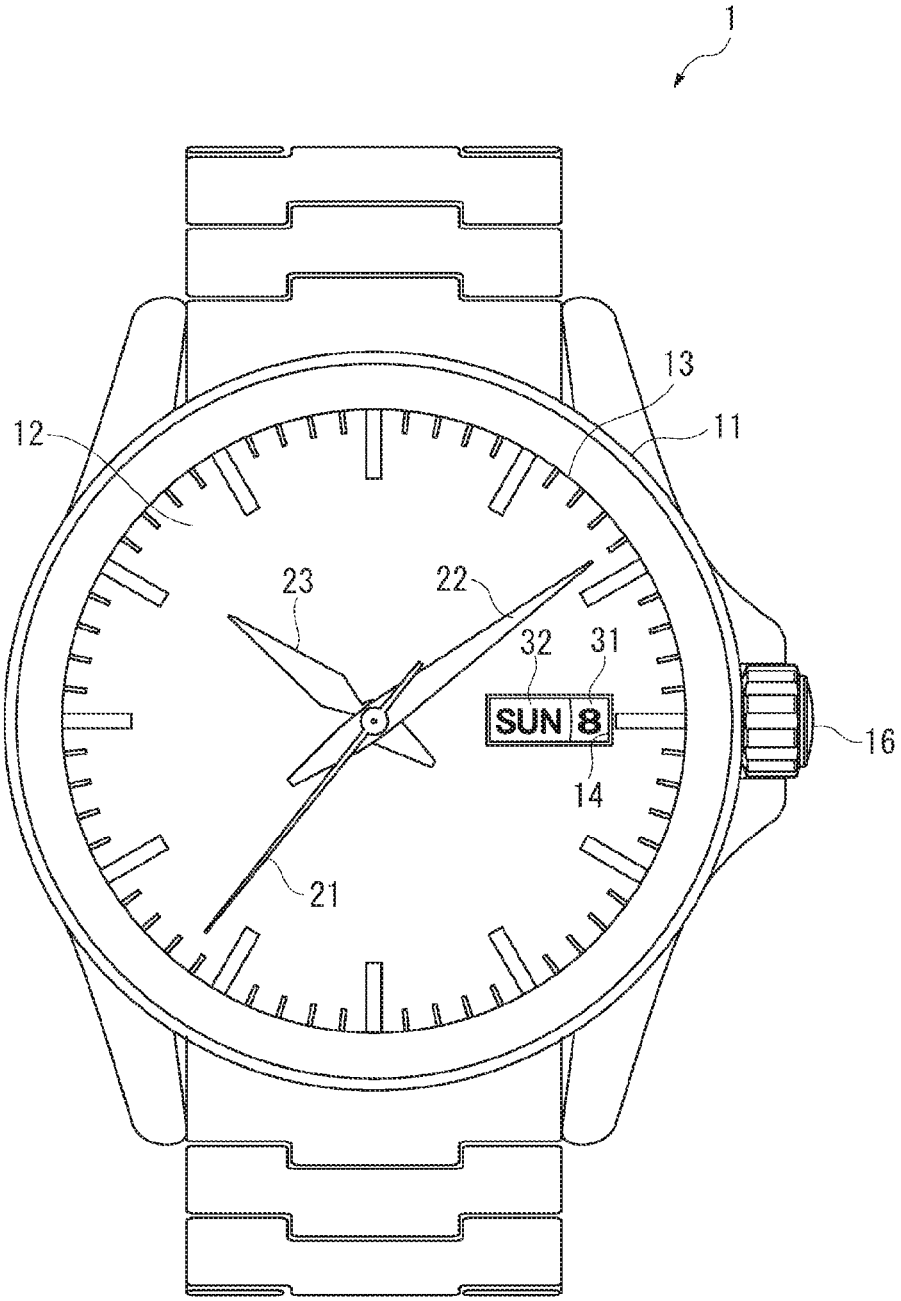
FIG. 1 is a front view of a timepiece according to an embodiment of the invention.

FIG. 1 is a front view showing the timepiece 1.

The timepiece 1 is a wristwatch worn around a user's wrist and includes a cylindrical exterior case 11, and a disk-shaped dial 12 is disposed as a time display portion inside the inner circumference of the exterior case 11. The exterior case 11 has two openings, with the front-side opening closed with a cover glass plate 13 and the rear-side opening closed with a case back that is not shown.

The timepiece 1 further includes a movement 2 (FIG. 2), which is accommodated in the exterior case 11, a second hand 21, a minute hand 22, and an hour hand 23.

The time indicating hands 21 to 23 are attached to a time indicating hand shaft of the movement 2 and driven by the movement 2. The time indicating hands 21 to 23 are disposed on the front side of the dial 12, and the movement 2 is disposed on the rear side of the dial 12.

The dial 12 is provided with a calendar small window 14, through which numerals on a date indicator 31 and days on a day indicate 32 are visible. The numerals on the date indicator 31 represent the "date" out of the year, month, and date.

A crown 16 is provided on the side surface of the exterior case 11. Operating the crown 16 allows input according to the operation.

The crown 16 can be pulled two steps from a normal position (zeroth-step position) that is a position in which the crown 16 is pushed toward the center of the timepiece 1. The position where the crown 16 is pulled one step is called a first-step position, and the position where the crown 16 is pulled two steps is called a second-step position. In the present embodiment, the first-step position is a first position according to the invention, and the second-step position is a second position according to the invention.

Movement of Timepiece 1

Figure 2:
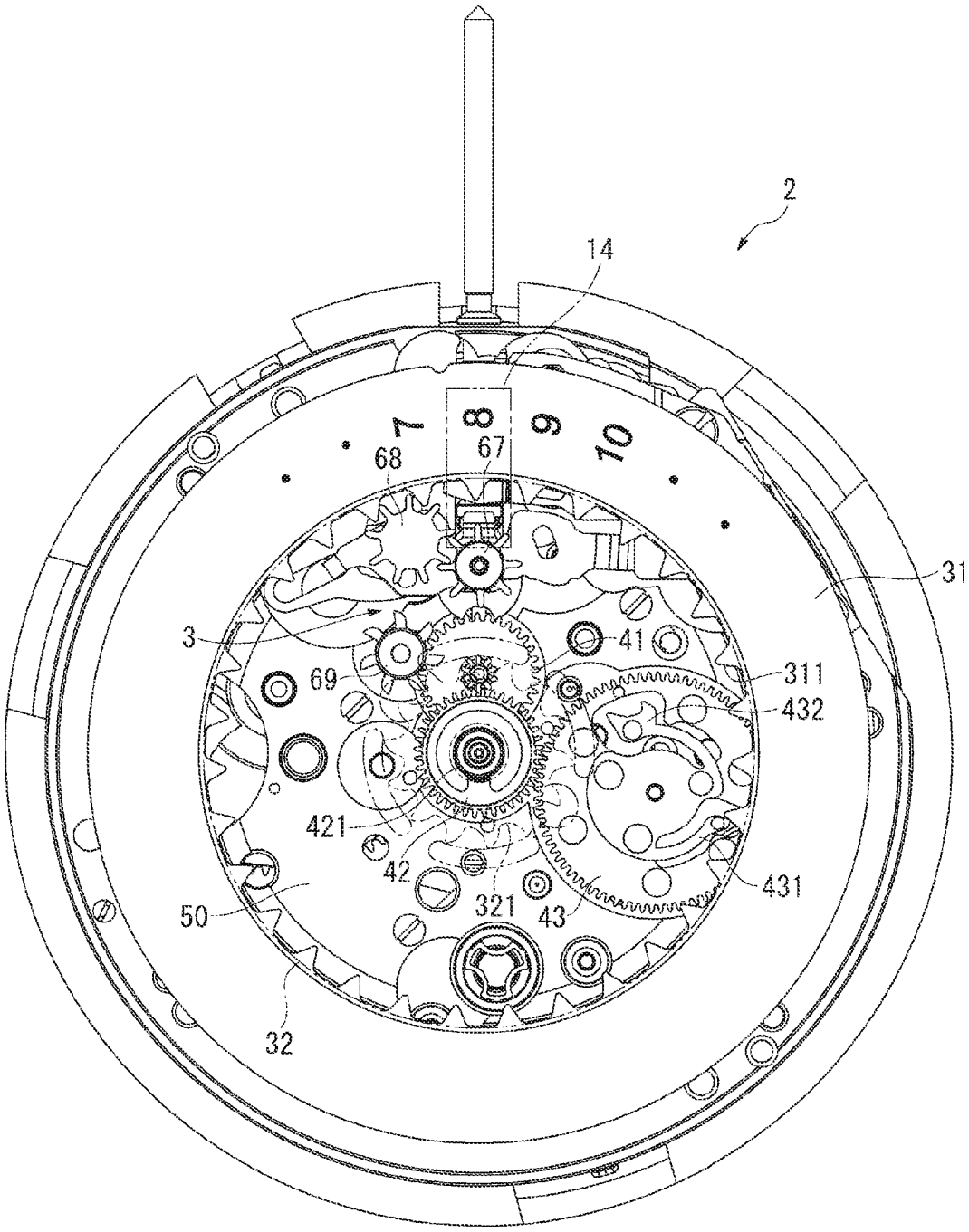
FIG. 2 is a plan view of a movement of the timepiece.

FIG. 2 is a plan view in which the movement 2 of the timepiece 1 is viewed from the side where the dial 12 is present. In FIG. 2, a date jumper (date indicator guide), a date indicator maintaining plate, and other components are omitted.

The movement 2 is provided with the date indicator 31, which is formed in a ring shape, on the side facing the dial 12, as shown in FIG. 2. The date indicator 31 is a first calendar wheel according to the invention. The date indicator 31 is so disposed that the center thereof in a plan view is positioned at the center of the movement 2 in the plan view. On the front surface (surface facing dial 12) of the date indicator 31 are printed numerals "1" to "31" representing the date in the rightward (clockwise) rotation direction. An internal gear 311, which is formed of 31 teeth, is provided along the inner circumferential edge of the date indicator 31.

The movement 2 is further provided with the day indicator 32, which is formed in a disk-shape, on the side facing the dial 12 and inside the inner circumference of the date indicator 31. On the front surface of the day indicator 32 are printed characters representing the seven days of the week that are not shown. The day indicator 32 further includes a day star 321 on the rear side thereof (side facing case back).

The movement 2 includes a minute wheel 41, which is driven and rotated when drive force outputted from a mainspring is transmitted via a cannon pinion that is not shown, and an hour wheel 42, which rotates in synchronization with the minute wheel 41.

The hour wheel 42 includes an hour hand attachment shaft 421, to which the hour hand 23 is attached. A minute hand attachment shaft (cannon pinion of center wheel & pinion) and a second hand attachment shaft (second wheel & pinion) are provided inside the hour hand attachment shaft 421. The minute hand 22 is attached to the minute hand attachment shaft and the second hand 21 is attached to the second hand attachment shaft.

The movement 2 further includes a date indicator driving wheel 43, which makes one leftward (counterclockwise) rotation in 24 hours in synchronization with the hour wheel 42. The terms "leftward rotation" and "rightward rotation" used in the description represent directions of rotation in a case where the timepiece 1 is viewed from the front side thereof. In the present embodiment, the rightward rotation (clockwise rotation) corresponds to a first direction according to the invention, and the leftward rotation (counterclockwise rotation) corresponds to a second direction according to the invention.

The date indicator driving wheel 43 includes a date finger 431, which forwards the internal gear 311 of the date indicator 31 by one tooth per date to rotate the date indicator 31 leftward by an amount corresponding to one date.

The date indicator driving wheel 43 further includes a day finger 432, which forwards the day star 321, with which the day indicator 32 is provided, to rotate the day indicator 32 rightward by an amount corresponding to one day. On the day indicator 32 are written the days of the week alternately in Japanese and English, and one of the Japanese and English characters can be chosen by shifting the position of the day indicator 32 at the time of assembly. The day finger 432 therefore forwards the day star 321 by two teeth in one day. As described above, the date indicator driving wheel 43 also serves as a day indicator driving wheel. The date finger 431 and the day finger 432 of the date indicator driving wheel 43 are so designed that the timing at which the date finger 431 forwards the date indicator 31 differs from the timing at which the day finger 432 forwards the day indicator 32. The date indicator driving wheel 43 can therefore be rotated with a smaller magnitude of force than in a case where the date finger 431 and the day finger 432 forward the date indicator 31 and the day indicator 32 at the same timing.

A main plate 50, with which the movement 2 is provided, is provided with a shaft 45, to which a power reserve hand 24, with which the timepiece 1A, which will be described later, is attached. The main plate 50 is further provided with attachment sections which are not shown but to which a date indicator driving wheel 43A and an intermediate date wheel 46, with which the timepiece 1A is provided, are attached.

Calendar Corrector Mechanism of Timepiece 1

A calendar corrector mechanism 3, with which the movement 2 is provided, will next be described. The description will be made with reference to a state in which the crown 16 is located at the zeroth-step position.

Figure 3:
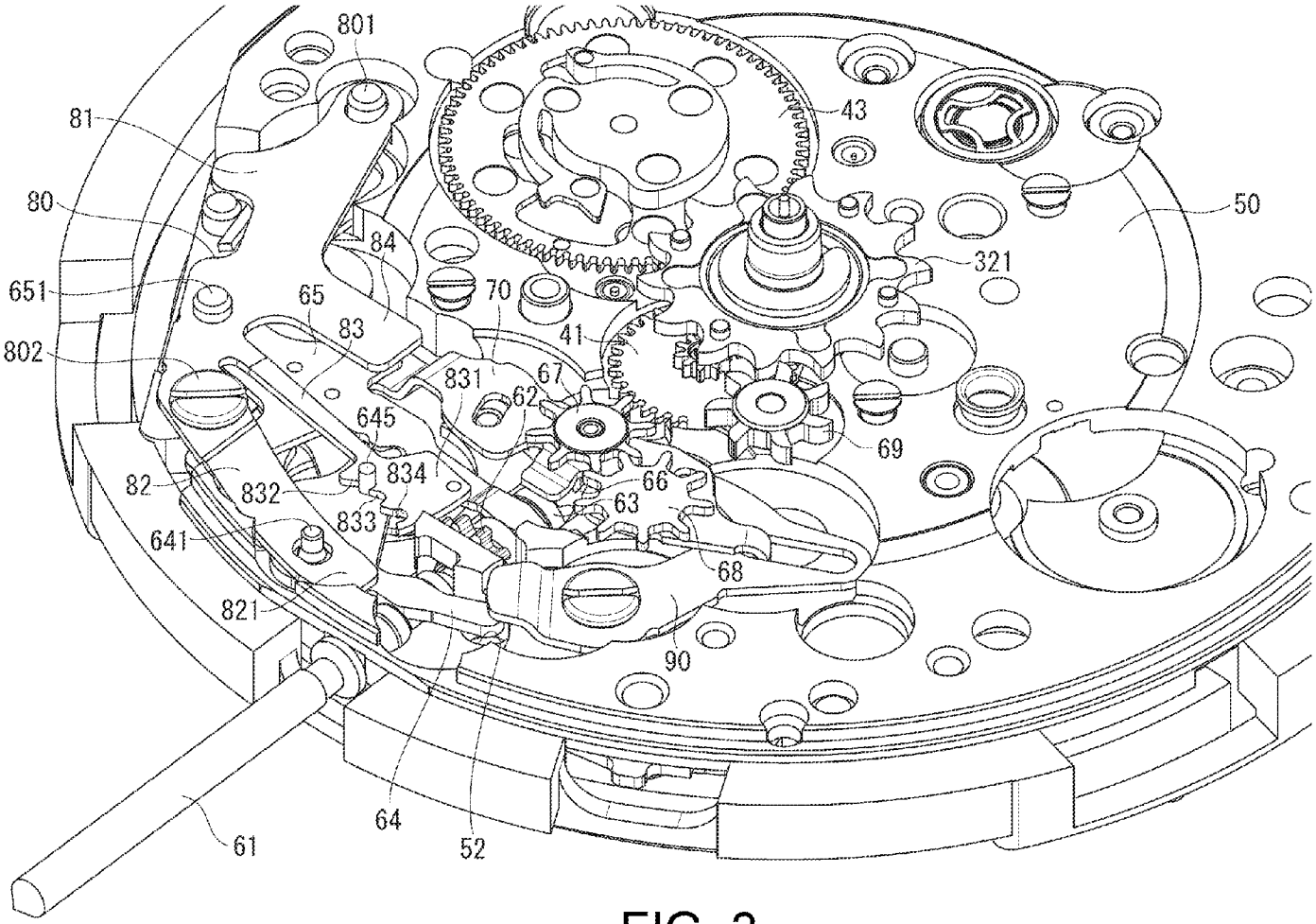
FIG. 3 is a perspective view of the movement of the timepiece.
Figure 4:
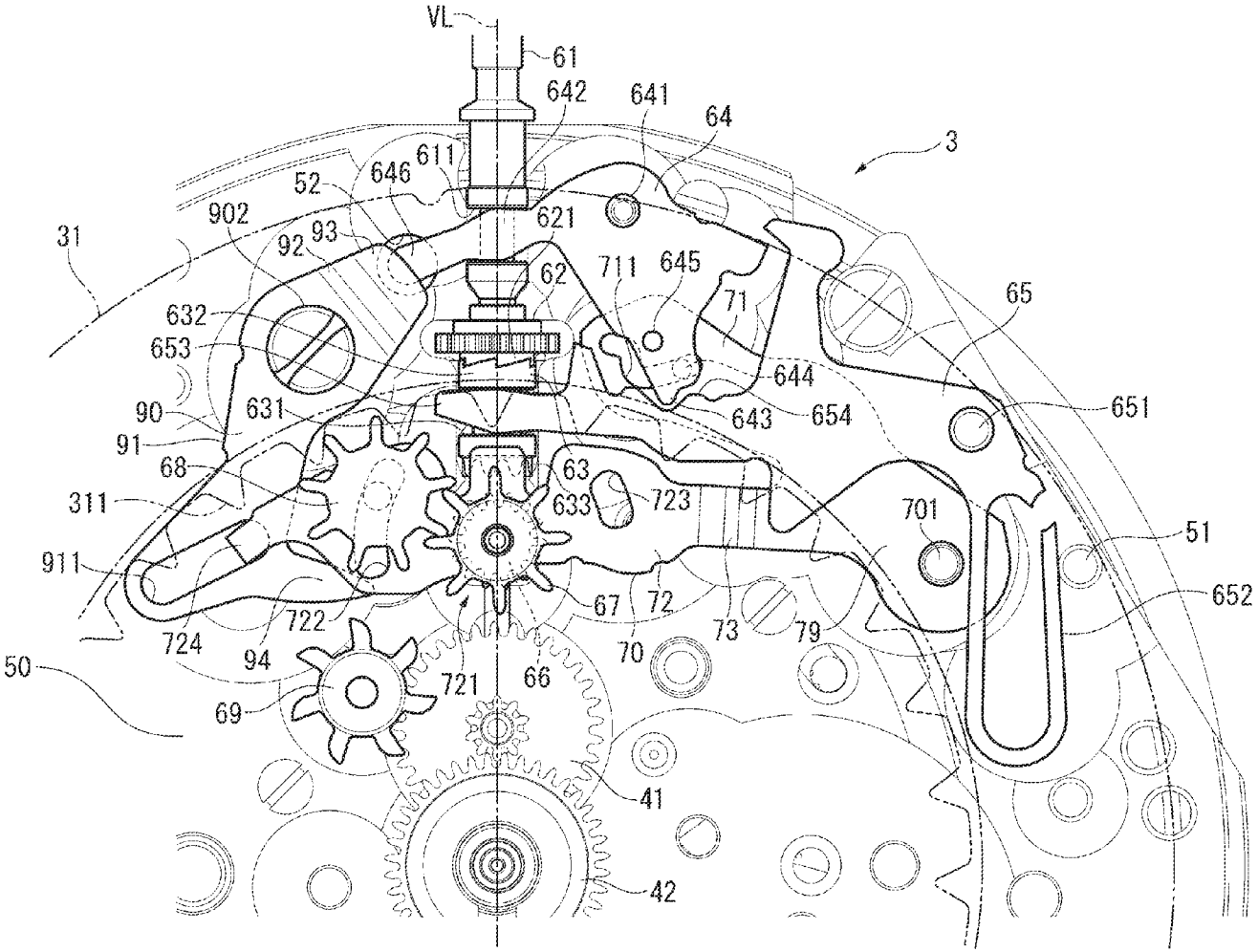
FIG. 4 shows a calendar corrector mechanism of the timepiece in a state in which a crown is located in a zeroth-step position.

The calendar corrector mechanism 3 includes a winding stem 61, a winding pinion 62, a clutch wheel 63, a setting lever 64, a yoke 65, a setting wheel lever 70, a setting wheel 66, a calendar correction transfer wheel 67, a calendar corrector wheel 68, a day corrector wheel 69, a setting lever jumper 80, and a corrector lever 90, as shown in FIGS. 3 and 4. The setting lever jumper 80 is shown in FIG. 3 but omitted in FIG. 4.

Winding Stem

The winding stem 61 engages with the crown 16 and moves in the axial direction of the winding stem 61 when the crown 16 is pulled out. That is, the winding stem 61 is normally located at the zeroth-step position and moves to the first-step position or the second-step position when the crown 16 is pulled out.

The winding stem 61 is provided with an engaging groove 611, which engages with the setting lever 64, as shown in FIG. 4.

Setting Lever

The setting lever 64 is so supported with a shaft 641, which is provided on the main plate 50, as to be swingable around the shaft 641, as shown in FIG. 4. The setting lever 64 includes an engaging section 642 and a manipulator 646, which extends from the engaging section 642. The engaging section 642 engages with the engaging groove 611 of the winding stem 61. The setting lever 64 thus swings around the shaft 641 in synchronization with the winding stem 61.

The manipulator 646 is provided on the side opposite the shaft 641 with respect to the winding stem 61 in a plan view in which the movement 2 is viewed from the side where the dial 12 is present, as shown in FIGS. 3 and 4, so that the manipulator 646 does not overlap with the setting lever jumper 80, which will be described later. The manipulator 646 overlaps with a through hole 52, which is provided through the main plate 50, in the plan view described above when the winding stem 61 is located at the zeroth-step position.

In a case where the crown 16 is exchanged or any other operation is performed, when the winding stem 61 is pulled out of the movement 2, the engaging section 642 of the setting lever 64 needs to disengage from the engaging groove 611 of the winding stem 61. The through hole 52 is used for the disengagement. That is, in the state in which the winding stem 61 is located at the zeroth-step position, in which the manipulator 646 overlaps with the through hole 52, a rod-shaped pressing member can be inserted from the case back side through the through hole 52 so that the pressing member pushes the manipulator 646 toward the dial 12. Although the setting lever jumper 80, which will be described later, prevents the setting lever 64 from falling off the main plate 50, elasticity of the setting lever jumper 80 allows the setting lever 64 to incline when the manipulator 646 is pressed by pressing member, and the manipulator 646 moves toward the dial 12. The engagement between the engaging section 642 and the engaging groove 611 can thus be released.

When the winding stem 61 is pulled out to the first-step position or the second-step position, the manipulator 646 moves to a position where it does not overlap with the through hole 52, as will be described later. Therefore, in the case where the winding stem 61 is located at the first-step position or the second-step position, even when the pressing member is inserted through the through hole 52, the pressing member cannot press the manipulator 646, and the engagement between the engaging section 642 and the engaging groove 611 cannot be released.

The setting lever 64 further includes a front end section 643, which positions the yoke 65, as shown in FIG. 4.

The setting lever 64 is provided with a protruding pin 644, which protrudes toward the main plate 50 and positions the setting wheel lever 70, in a position in the vicinity of the front end section 643.

The setting lever 64 is further provided with a protruding pin 645, which protrudes toward the dial 12 and engages with engaging grooves 832, 833, and 834 of a click spring section 83 of the setting lever jumper 80, which will be described later, in a position in the vicinity of the front end section 643, as shown in FIGS. 3 and 4.

Yoke

The yoke 65 is disposed at the same level as the setting lever 64 in the thickness direction of the movement 2. The yoke 65 is supported with a shaft 651 provided on the main plate 50, as shown in FIG. 4. A spring section 652 of the yoke 65 is so attached as to press a protrusion 51 provided on the main plate 50, whereby the yoke 65 is so urged that an end section 653 thereof moves toward the outer edge of the timepiece (in a direction in which the end section 653 approaches the winding pinion 62). The yoke 65, which bends, is configured to be swingable in a direction in which the end section 653 moves toward the center of the timepiece and in a direction in which the end section 653 moves toward the outer edge of the timepiece.

The timepiece-outer-edge-side side surface of the yoke 65 is provided with a side surface section 654, which comes into contact with the front end section 643 of the setting lever 64. The front end section 643, which comes into contact with the side surface section 654, restricts the position of the yoke 65. That is, the position of the yoke 65 is determined by the spring section 652 and the front end section 643.

Clutch Wheel

The clutch wheel 63 includes an engaging groove 631, which engages with the end section 653 of the yoke 65, an engaging section 632, which engages with the winding pinion 62, and a gear 633, as shown in FIG. 4. The clutch wheel 63 is provided with a hole passing through the center of rotation of the clutch wheel 63, and the winding stem 61 is inserted through the hole.

The clutch wheel 63 is so attached to the winding step 61 as to be movable in the axial direction of the winding stem 61 but not to be rotatable therearound.

That is, the clutch wheel 63 moves along the axial direction of the winding stem 61 in synchronization with the yoke 65 and engages with the winding stem 61 and rotates integrally therewith.

Winding Pinion

The winding pinion 62 includes an engaging section 621, which engages with the engaging section 632 of the clutch wheel 63, as shown in FIG. 4. The winding pinion 62 is provided with a hole passing through the center of rotation of the winding pinion 62, and the winding stem 61 is inserted through the hole. The winding pinion 62 is so attached to the winding stem 61 as to be rotatable therearound.

When the crown 16 in the state in which it engages with the clutch wheel 63 is rotated leftward, the winding pinion 62 rotates integrally with the clutch wheel 63 and winds the mainspring up via a rotational force transmission mechanism, such as a crown wheel and a ratchet wheel that are not shown. The winding pinion 62 is so configured that when the crown 16 is rotated rightward, the engaging section 621 disengages from the engaging section 632 of the clutch wheel 63 and the winding pinion 62 does not rotate.

Setting Wheel Lever

The setting wheel lever 70 is so supported by a shaft (swing shaft) 701 provided on the main plate 50 as to be swingable around the shaft 701, as shown in FIG. 4. The shaft 701 is disposed in a position where the shaft 701 overlaps with the date indicator 31 in the plan view in which the movement 2 is viewed from the side where the dial 12 is present.

The setting wheel lever 70 includes a base end section 79, with which the shaft 701 is provided, and a positioning section 71 and a support section 72, which extend from the base end section 79. The support section 72 extends from the base end section 79 in a direction that intersects a straight line VL passing through the axis of the winding stem 61. The support section 72 includes a bent section 73 on the side facing the base end section 79. An end section of the bent section 73 on the side opposite the base end section 79 is closer to the dial 12 than an end section of the bent section 73 on the side facing the base end section 79.

The positioning section 71 is so disposed as to overlap with the setting lever 64 and the yoke 65 in the plan view described above and disposed in a position shifted toward the main plate 50 with respect to the setting lever 64 and the yoke 65. The support section 72 is disposed inside the inner circumference of the date indicator 31 in the plan view described above and disposed in a position shifted toward the dial 12 with respect to the setting lever 64 and the yoke 65.

The positioning section 71 is provided with an engagement hole 711, which engages with the protruding pin 644 on the setting lever 64. The protruding pin 644, which engages with the engagement hole 711, restricts the position of the setting wheel lever 70. That is, the position of the setting wheel lever 70 is determined by the protruding pin 644.

The support section 72 is so provided as to intersect the straight light VL. The support section 72 has a shaft receiving section 721, which intersects the straight line VL and has a shaft receiving hole that is not shown but rotatably supports the setting wheel 66 and the calendar correction transfer wheel 67, which is attached to the same rotating shaft to which the setting wheel 66 is attached.

The setting wheel 66 is disposed in a position shifted toward the main plat 50 with respect to the setting wheel lever 70, and the calendar correction transfer wheel 67 is disposed in a position shifted toward the dial 12 with respect to the setting wheel lever 70. Since the calendar correction transfer wheel 67 is fixed to the same rotating shaft to which the setting wheel 66 is fixed, the calendar correction transfer wheel 67 rotates integrally with the setting wheel 66.

The setting wheel 66 and the calendar correction transfer wheel 67, the minute wheel 41, and the hour wheel 42 are so disposed that the rotating shafts thereof are roughly located on the straight line VL.

On the side opposite the shaft 701 with respect to the shaft receiving section 721, the support section 72 has a shaft receiving hole 722, which can rotatably support the calendar corrector wheel 68. In a position shifted from the shaft receiving section 721 toward the shaft 701, the support section 72 has a shaft receiving hole 723, which can rotatably support a calendar corrector wheel 68A of the timepiece 1A, which will be described later. That is, the shaft receiving hole 722 is provided on the side opposite the shaft 701 with respect to the straight line VL, and the shaft receiving hole 723 is provided in a position shifted from the straight line VL toward the shaft 701. That is, the shaft receiving hole 722 and the shaft receiving hole 723 are so provided as to sandwich the calendar correction transfer wheel 67. The shaft receiving hole 722 is a first attachment section according to the invention, and the shaft receiving hole 723 is a second attachment section according to the invention.

Each of the shaft receiving holes 722 and 723 is an elongated hole formed along an arc concentric with the calendar correction transfer wheel 67 in the plan view described above. The shaft receiving hole 722 is longer than the shaft receiving hole 723 in the elongated direction. Each of the shaft receiving hole 722 and the shaft receiving hole 723 has one end along the arc closer to the inner circumferential edge of the date indicator 31 than the other end of the shaft receiving hole.

The support section 72 further has a front end section 724, which engages with an engagement hole 911 of the corrector lever 90, which will be described later.

Calendar Corrector Wheel

The calendar corrector wheel 68 is supported by the shaft receiving hole 722 of the setting wheel lever 70, as shown in FIG. 4. In the timepiece 1A, which will be described later, the calendar corrector wheel 68A is supported by the shaft receiving hole 723.

The calendar corrector wheel 68 rotates in synchronization with the calendar correction transfer wheel 67.

The calendar corrector wheel 68 is disposed at the same level as the date indicator 31 in the thickness direction of the movement 2.

Setting Lever Jumper

The setting lever jumper 80 is fixed to the main plate 50 with a screw 802, as shown in FIG. 3. The setting lever 64, the yoke 65, and the setting wheel lever 70 are provided between the setting lever jumper 80 and the main plate 50. The setting lever jumper 80 is positioned by the shaft 651 and a shaft 801, which are provided on the main plate 50, and the screw 802. The setting lever jumper 80, which has elasticity and is initially bent, presses the setting lever 64, the yoke 65, and the setting wheel lever 70 toward the main plate 50 with force small enough not to prevent the movement thereof in synchronization with the winding stem 61. The thus configured setting lever jumper 80 prevents the setting lever 64, the yoke 65, and the setting wheel lever 70 from falling off from the main plate 50.

The setting lever jumper 80 includes a base end section 81, with which the shaft 651 and the shaft 801 are provided, a setting lever pressing section 82, which extends from the base end section 81, a click spring section 83, which extends from the base end section 81, and an extension section 84, which extends from the base end section 81.

The setting lever pressing section 82 has a front end portion 821, which has a hole through which the shaft 641 provided on the main plate 50 is inserted. The front end section 821 prevents the setting lever 64 from falling off the main plate 50.

The side surface of a front end section 831 of the click spring section 83 is provided with three engaging grooves 832, 833, and 834, which engage with the protruding pin 645 on the setting lever 64. When the crown 16 is pushed in or pulled out, the protruding pin 645 engages with any of the three engaging grooves 832, 833, and 834 and restricts the position of the setting lever 64, whereby the position of the winding stem 61, that is, the position of the crown 16 can be restricted in the zeroth-step position, the first-step position, or the second-step position and the user can feel a clicking sensation.

The extension section 84 prevents the yoke 65 and the setting wheel lever 70 from falling off the main plate 50.

Corrector Lever

The corrector lever 90 is swingably attached to a screw (shaft) 902, as shown in FIG. 4. Movement of the corrector lever 90 toward the dial 12 is restricted by the head of the screw 902. The gap between the main plate 50 and the head of the screw 902 is minimized to the extent that the corrector lever 90 is swingable. The screw 902 is provided in a position where it overlaps with the date indicator 31 in the view in which the movement 2 is viewed from the side where the dial 12 is present.

The corrector lever 90 includes a main body section 91, with which the screw 902 is provided, a restricting section 93, which extends from the main body section 91 via a bent section 92, and an engagement restricting section 94, which extends from the main body section 91.

The main body section 91 is provided with an engagement hole 911, which engages with the front end section 724 of the support section 72 of the setting wheel lever 70. The engagement hole 911 is formed in an elongated shape in the plan view described above. When the setting wheel lever 70 moves in the leftward rotation (counterclockwise rotation) direction, the front end section 724 of the setting wheel lever 70 presses one of the inner side surfaces of the engagement hole 911, that is, the inner side surface on the side toward which the setting wheel lever 70 moves, whereby the corrector lever 90 moves in the leftward rotation direction. On the other hand, when the setting wheel lever 70 moves in the rightward rotation (clockwise rotation) direction, the front end section 724 of the setting wheel lever 70 presses the other one of the inner side surfaces of the engagement hole 911, that is, the inner side surface on the side toward which the setting wheel lever 70 moves, whereby the corrector lever 90 moves in the rightward rotation direction. The corrector lever 90 thus swings around the screw 902 in synchronization with the setting wheel lever 70.

The restricting section 93 is provided between the manipulator 646 of the setting lever 64 and the date indicator 31 and further so provided that when the winding stem 61 is located in the zeroth-step position, the restricting section 93 overlaps with the through hole 52 and the manipulator 646 of the setting lever 64 in the plan view described above. Therefore, in the state in which the winding stem 61 is located in the zeroth-step position, when the manipulator 646 of the setting lever 64 is pressed toward the dial 12 by the pressing member inserted through the through hole 52 and the setting lever 64 is therefore inclined, the manipulator 646 moves to the position of the restricting section 93 and comes into contact with the restricting section 93, so that the manipulator 646 is not allowed to move any more. That is, the restricting section 93 functions as a positions determination section that determines the travel of the manipulator 646 toward the dial 12.

As will be described later, when the winding stem 61 is pulled out to the first-step position or the second-step position, the restricting section 93 does not overlap with the manipulator 646 but overlaps with the through hole 52 in the plan view described above. Therefore, in the case where the winding stem is located in the first-step position or the second-step position, when the pressing member is inserted into the through hole 52, the pressing member reaches the position of the restricting section 93, comes into contact with the restricting section 93, and is not allowed to move any more.

The engagement restricting section 94 is located in a position shifted from the support section 72 of the setting wheel lever 70 toward the main plate 50. Although will be described later in detail, when the winding stem 61 is located in the second-step position, the engagement restricting section 94 restricts the movement of the calendar corrector wheel 68 and therefore prevents the calendar corrector wheel 68 from meshing (engaging) with the day corrector wheel 69, which will be described later.

The corrector lever 90 is made of a metal, such as iron, which is not a nonferrous metal, or an alloy primarily containing iron. The corrector lever 90, which is an operable part, is restricted in terms of shape, and it is therefore difficult to ensure rigidity of the corrector lever 90 by means of shape. However, forming the corrector lever 90 by using a metal that is not a nonferrous metal allows rigidity to be ensured. Forming the corrector lever 90 by using a metal that is not a nonferrous metal further allows the thickness of the corrector lever 90 to be set at about 0.2 mm, which is about ⅔ to ½ of the thickness achieved when the corrector lever 90 is made of a nonferrous metal.

Day Corrector Wheel

The day corrector wheel 69 is provided on the side opposite the shaft 701 of the setting wheel lever 70 with respect to the straight line VL, as shown in FIG. 4, and meshes with the day star 321 (FIGS. 2 and 3).

Action in Zeroth-Step Position

The action of the calendar corrector mechanism 3 in the case where the crown 16 is located in the zeroth-step position will next be described.

In this case, the winding pinion 62 has engaged with the clutch wheel 63 and rotates integrally therewith, as shown in FIG. 4. The setting wheel 66 is separate from the clutch wheel 63 and therefore does not rotate in synchronization with the clutch wheel 63.

Therefore, when the crown 16 is rotated leftward, the winding pinion 62 rotates, whereby the mainspring is wound up via the rotational force transmission mechanism that is not shown. It is noted that when the crown 16 is rotated rightward, the winding pinion 62 does not rotate.

Further, even when the crown 16 is rotated, the setting wheel 66 does not rotate, and the calendar correction transfer wheel 67, the calendar corrector wheel 68, the date indicator 31, or the day indicator 32 therefore does not rotate.

First-Step Position

The action of the calendar corrector mechanism 3 in the case where the crown 16 is pulled out to the first-step position will next be described.

Figure 5:
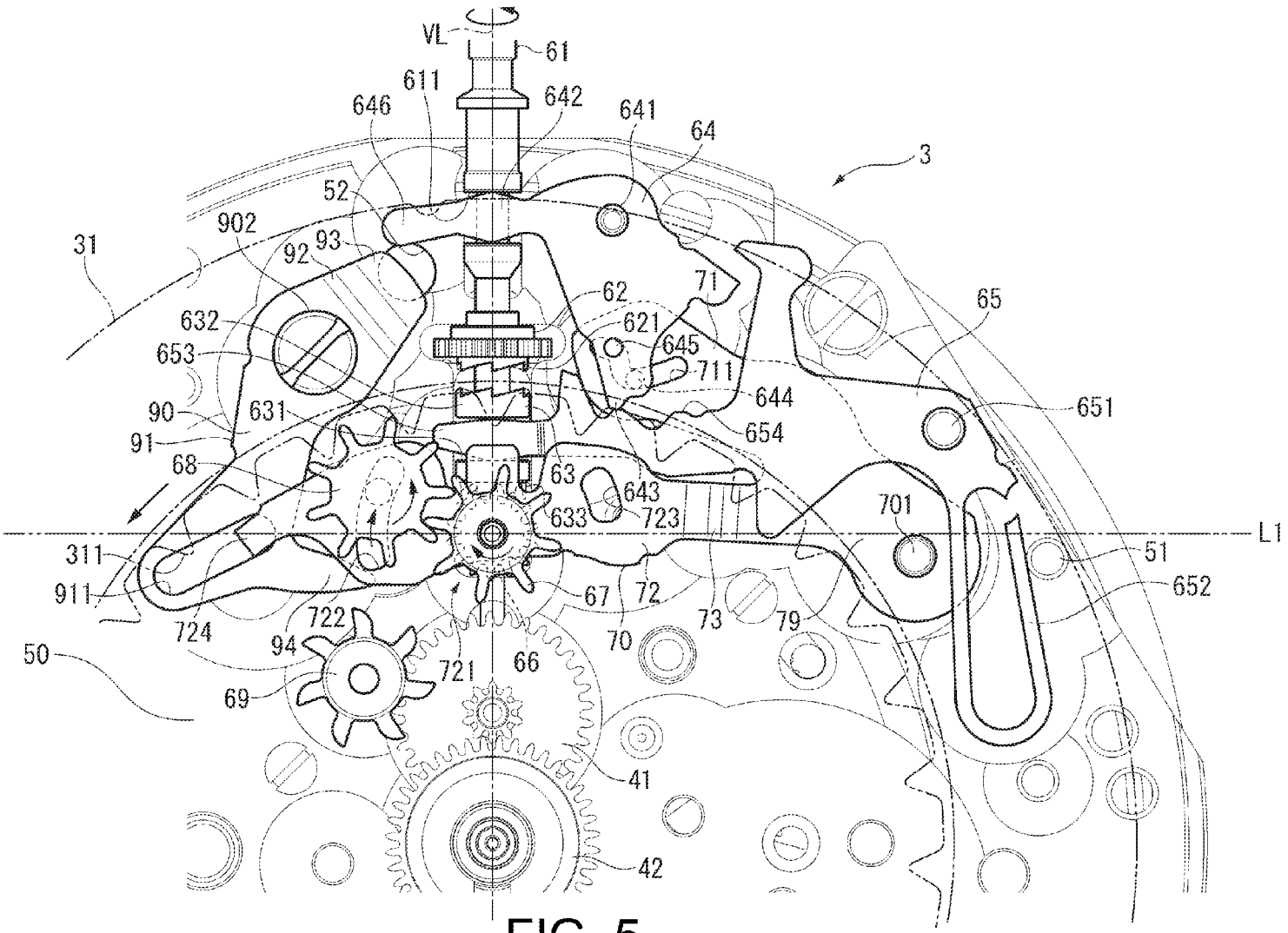
FIG. 5 shows the calendar corrector mechanism of the timepiece in a state in which the crown is located in a first-step position (rotated leftward).

FIG. 5 shows the calendar corrector mechanism 3 in the case where the crown 16 is located in the first-step position.

When the crown 16 is pulled out from the zeroth-step position to the first-step position, the setting lever 64 rotates in synchronization with the winding stem 61, and the front end section 643 of the setting lever 64 moves along the side surface section 654 of the yoke 65. As a result, the spring section 652 of the yoke 65 is bent, and the end section 653 of the yoke 65 moves toward the center of the timepiece (in the direction away from the winding pinion 62), and the clutch wheel 63 moves in the direction toward the setting wheel 66 relative to the winding stem 61. As a result, the clutch wheel 63 separates from the winding pinion 62 and meshes (engages) with the setting wheel 66.

When the setting lever 64 moves, the protruding pin 644 on the setting lever 64 moves in the engagement hole 711 of the setting wheel lever 70, but the shape of the engagement hole 711 does not cause the setting wheel lever 70 to move.

The position to which the setting wheel lever 70 has moved in the case where the crown 16 is located in the zeroth-step position or the first-step position is called a first movement position.

Further, when the setting lever 64 moves, the manipulator 646 of the setting lever 64 moves to a position where the manipulator 646 does not overlap with the through hole 52 in the plan view described above. Therefore, even when the pressing member is inserted through the through hole 52, the pressing member cannot press the manipulator 646 and cannot therefore release the engagement between the engaging section 642 and the engaging groove 611.

Further, since the setting wheel lever 70 does not move, the corrector lever 90 also does not move, and the restricting section 93 of the corrector lever 90 overlaps with the through hole 52 in the plan view described above.

Rotate Crown Leftward in First-Step Position

When the crown 16 located in the first-step position is rotated leftward, the setting wheel 66 rotates rightward (clockwise), and the calendar correction transfer wheel 67 also rotates rightward integrally with the setting wheel 66, as shown in FIG. 5. The calendar corrector wheel 68 then rotates leftward (counterclockwise) in synchronization with the calendar correction transfer wheel 67.

When the calendar correction transfer wheel 67 rotates rightward, the calendar corrector wheel 68 receives force that causes the calendar corrector wheel 68 to approach the date indicator 31. The calendar corrector wheel 68 therefore moves in the direction toward the date indicator 31 along the shaft receiving hole 722 and meshes (engages) with the internal gear 311 of the date indicator 31. The date indicator 31 therefore rotates leftward in synchronization with the calendar corrector wheel 68. The date can thus be corrected.

Rotate Crown Rightward in First-Step Position

Figure 6:
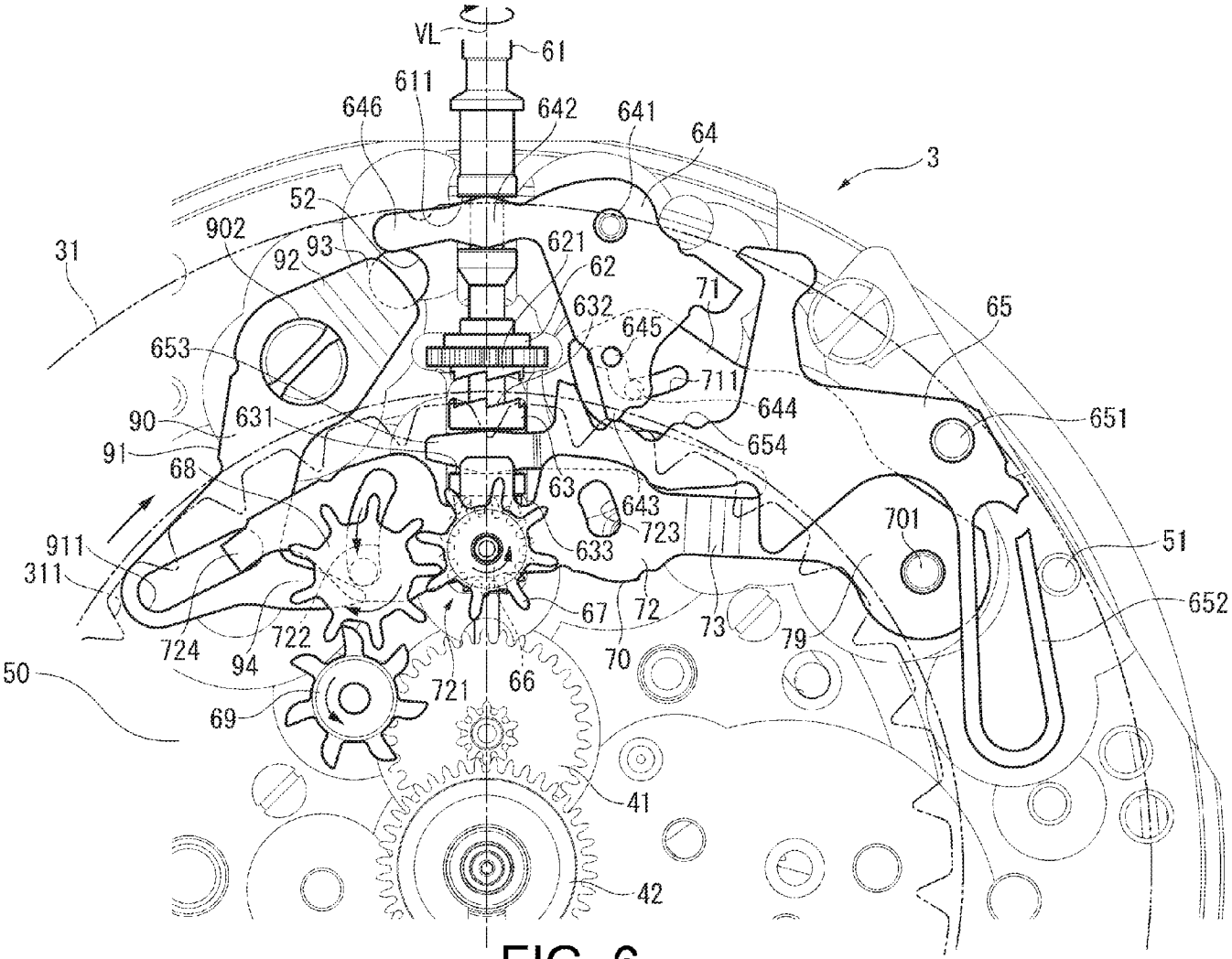
FIG. 6 shows the calendar corrector mechanism of the timepiece in the state in which the crown is located in the first-step position (rotated rightward).

On the other hand, when the crown 16 located in the first-step position is rotated rightward, the setting wheel 66 rotates leftward, and the calendar correction transfer wheel 67 also rotates leftward integrally with the setting wheel 66, as shown in FIG. 6. The calendar corrector wheel 68 then rotates rightward in synchronization with the calendar correction transfer wheel 67.

When the calendar correction transfer wheel 67 rotates leftward, the calendar corrector wheel 68 receives force that causes the calendar corrector wheel 68 to move away from the date indicator 31. The calendar corrector wheel 68 therefore moves in the direction away from the date indicator 31 along the shaft receiving hole 722, separates from the date indicator 31, and meshes (engages) with the day corrector wheel 69. The day corrector wheel 69 therefore rotates leftward in synchronization with the calendar corrector wheel 68. The day indicator 32 then rotates rightward in synchronization with the day corrector wheel 69. The day can thus be corrected.

At this point, since the engagement restricting section 94 of the corrector lever 90 does not overlap with the shaft receiving hole 722 in the plan view described above, the movement of the calendar corrector wheel 68 is not restricted.

Second-Step Position

The action of the calendar corrector mechanism 3 in the case where the crown 16 is pulled out to the second-step position will next be described.

Figure 7:
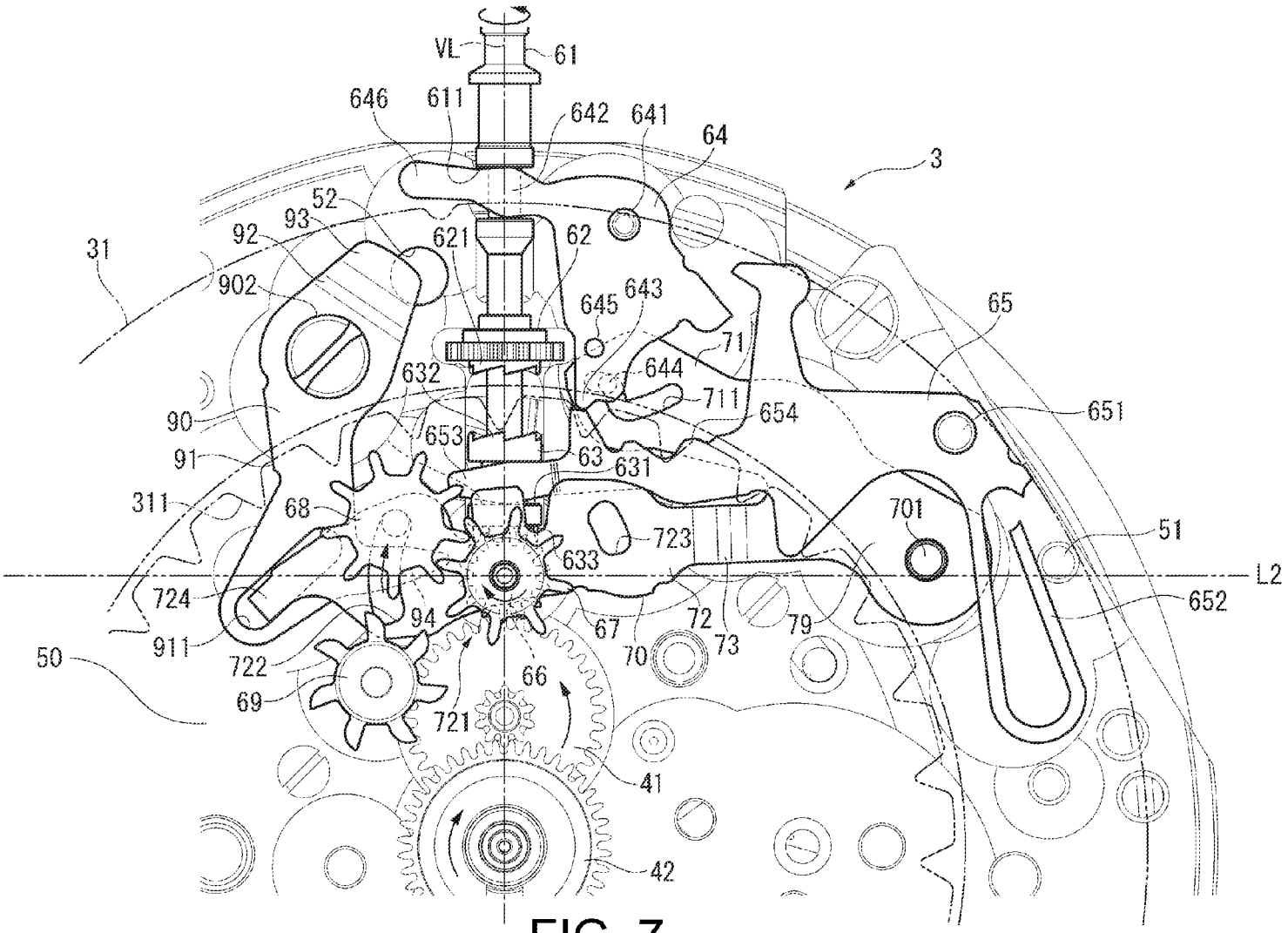
FIG. 7 is a plan view of the calendar corrector mechanism of the timepiece in a state in which the crown is located in a second-step position (rotated leftward).

FIG. 7 shows the calendar corrector mechanism 3 in the case where the crown 16 is located in the second-step position.

When the crown 16 is pulled out from the first-step position to the second-step position, the setting lever 64 rotates in synchronization with the winding stem 61, and the protruding pin 644 on the setting lever 64 moves in the engagement hole 711 of the setting wheel lever 70. As a result, the setting wheel lever 70 moves, and the support section 72 of the setting wheel lever 70 moves toward the center of the timepiece. The setting wheel 66 therefore moves toward the center of timepiece and meshes with the minute wheel 41.

The position to which the setting wheel lever 70 has moved in the case where the crown 16 is located in the second-step position is called a second movement position.

When the setting lever 64 rotates, the front end section 643 of the setting lever 64 moves along the side surface section 654 of the yoke 65. As a result, the spring section 652 of the yoke 65 is further bent, the end section 653 of the yoke 65 moves toward the center of the timepiece, and the clutch wheel 63 further moves in the direction toward the setting wheel 66 relative to the winding stem 61. As a result, the state in which the clutch wheel 63 and the setting wheel 66 mesh with each other is maintained.

The corrector lever 90 rotates in synchronization with the setting wheel lever 70, and the engagement restricting section 94 moves to a position where it overlaps with the shaft receiving hole 722 in the plan view described above.

The manipulator 646 of the setting lever 64 does not overlap with the through hole 52 in the plan view described above, but the restricting section 93 of the corrector lever 90 overlaps with the through hole 52 in the plan view described above.

Rotate Crown Leftward in Second-Step Position

When the crown 16 located in the second-step position is rotated leftward, the setting wheel 66 rotates rightward, and the minute wheel 41 rotates leftward in synchronization with the setting wheel 66, as shown in FIG. 7. The hour wheel 42 and other components then rotate rightward in synchronization with the minute wheel 41, whereby the hour hand attachment shaft 421 and the minute hand attachment shaft rotate.

The minute hand 22 and the hour hand 23 can thus be rotated rightward for correction of the displayed time.

The calendar correction transfer wheel 67 rotates rightward integrally with the setting wheel 66. In response to the rotation, the calendar corrector wheel 68 receives force that causes the calendar corrector wheel 68 to approach the date indicator 31 but does not move to the position where the calendar corrector wheel 68 meshes with the internal gear 311 of the date indicator 31 because the calendar corrector wheel 68 comes into contact with an end of the shaft receiving hole 722. The date indicator 31 therefore does not rotate.

Rotate Crown Rightward in Second-Step Position

Figure 8:
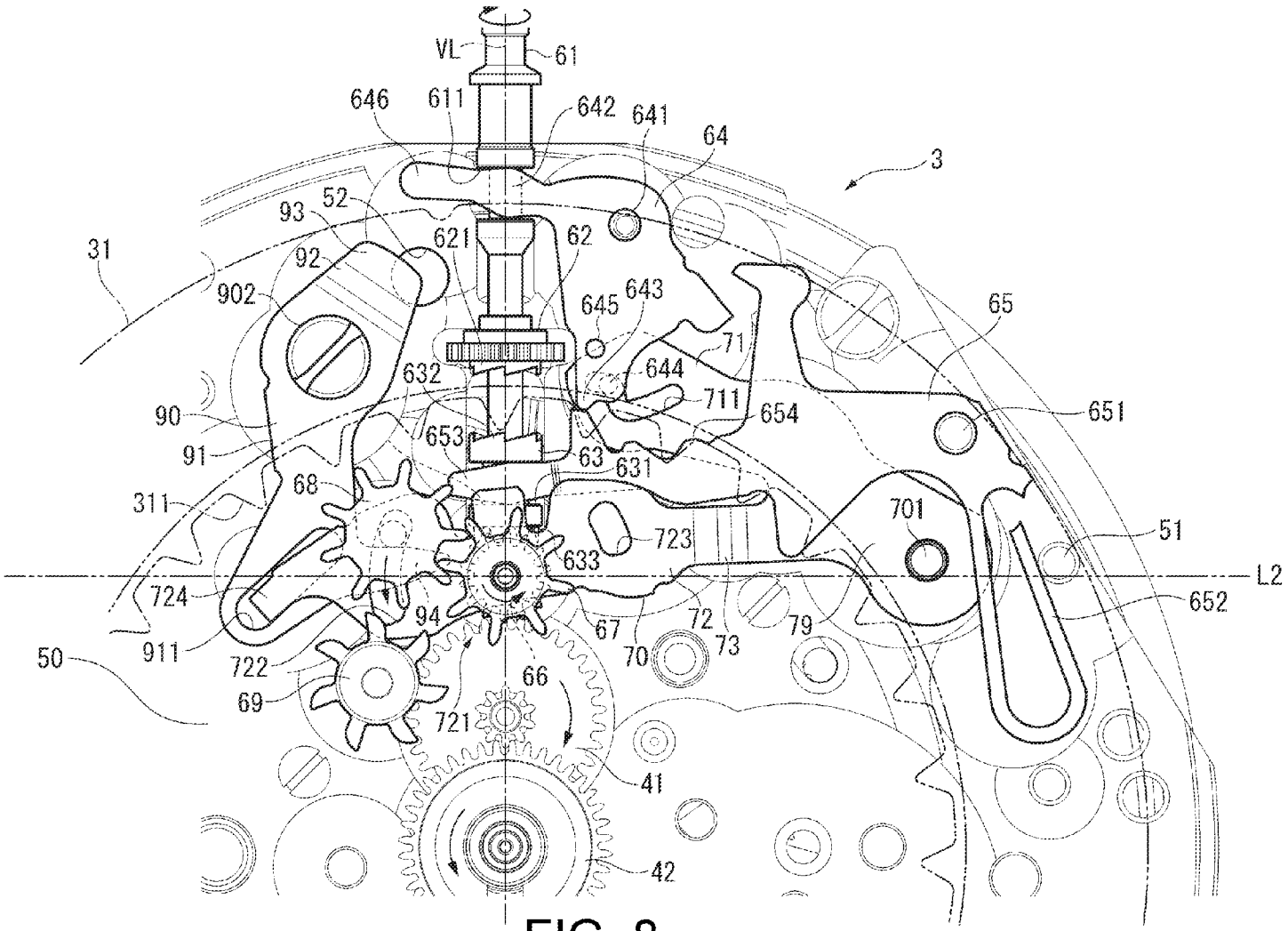
FIG. 8 is a plan view of the calendar corrector mechanism of the timepiece in the state in which the crown is located in the second-step position (rotated rightward).

On the other hand, when the crown 16 located in the second-step position is rotated rightward, the setting wheel 66 rotates leftward, and the minute wheel 41 rotates rightward in synchronization with the setting wheel 66, as shown in FIG. 8. The hour wheel 42 and other components then rotate leftward in synchronization with the minute wheel 41, whereby the hour hand attachment shaft 421 and the minute hand attachment shaft rotate.

The minute hand 22 and the hour hand 23 can thus be rotated leftward for correction of the displayed time.

The calendar correction transfer wheel 67 rotates leftward integrally with the setting wheel 66. In response to the rotation, the calendar corrector wheel 68 receives force that causes the calendar corrector wheel 68 to approach the day corrector wheel 69 but does not move to the position where the calendar corrector wheel 68 meshes with the day corrector wheel 69 because the rotating shaft of the calendar corrector wheel 68 comes into contact with the engagement restricting section 94 of the corrector lever 90. The day indicator 32 therefore does not rotate.

The shaft 701 of the setting wheel lever 70 intersects the straight line VL at right angles and is positioned between a first vertical line L1 (FIG. 5), which passes through the axis of rotation of the setting wheel 66 in the case where the setting wheel lever 70 is located in the first movement position, and a second vertical line L2 (FIGS. 7 and 8), which intersects the straight line VL and passes through the axis of rotation of the setting wheel 66 in the case where the setting wheel lever 70 is located in the second movement position.

Configuration of Timepiece 1A

The timepiece 1A will next be described.

Figure 9:
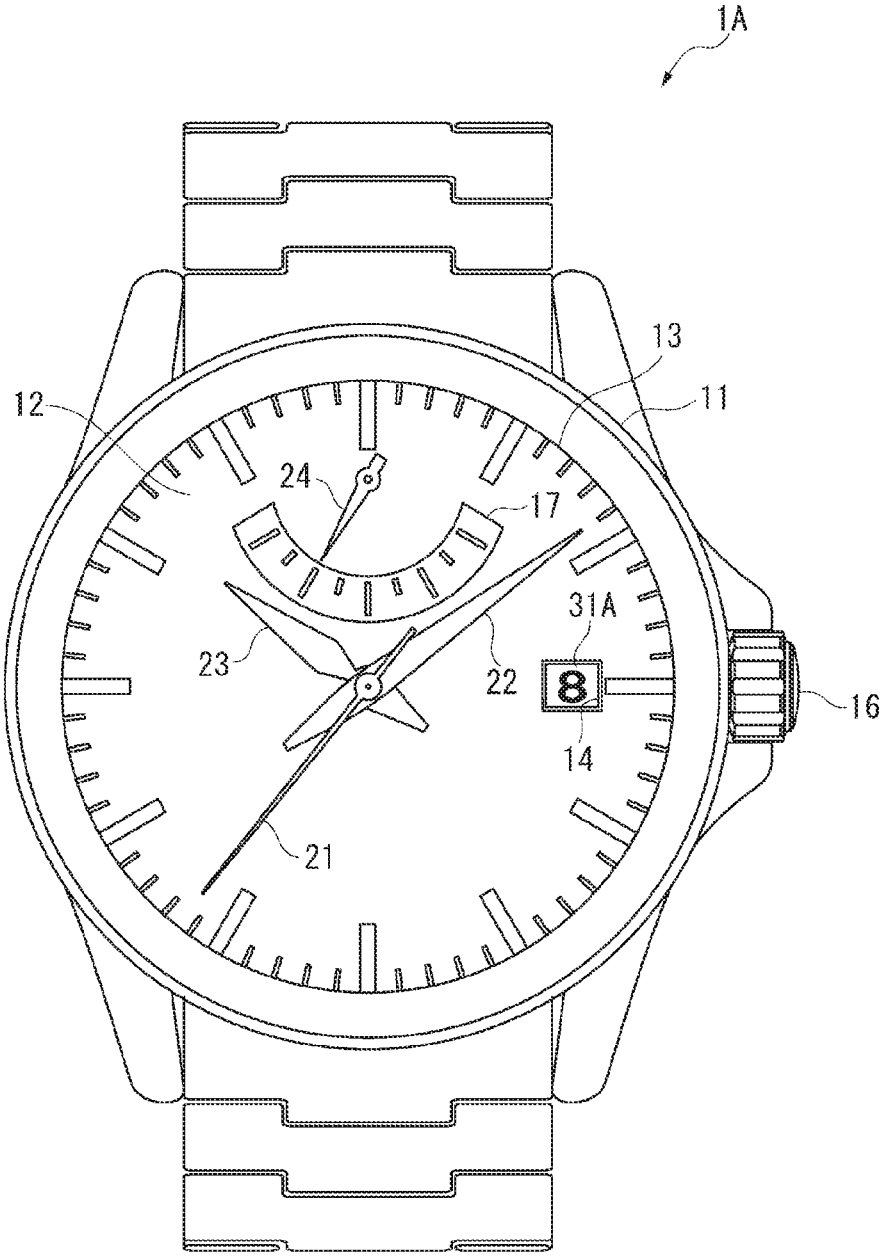
FIG. 9 is a front view of another timepiece according to the embodiment of the invention.

FIG. 9 is a front view showing the timepiece 1A. In the timepiece 1A, the same configurations as those of the timepiece 1 have the same reference characters and will not be described.

In the timepiece 1A, a power reserve hand 24 is provided in a position in the 12-o'clock position with respect to the center of the dial 12. Further, an arcuate sub-dial 17, on which markings are written, is provided along the outer circumference of a region over which the power reserve hand 24 rotates.

The power reserve hand 24 points any of the markings on the sub-dial 17 to display the remaining duration of the timepiece 1A (remaining wound-up amount of mainspring).

Numerals on a date indicator 31A, which will be described later, are visible through the calendar small window 14. The timepiece 1A is provided with no day indicator and therefore displays no days.

Movement of Timepiece 1A

Figure 10:
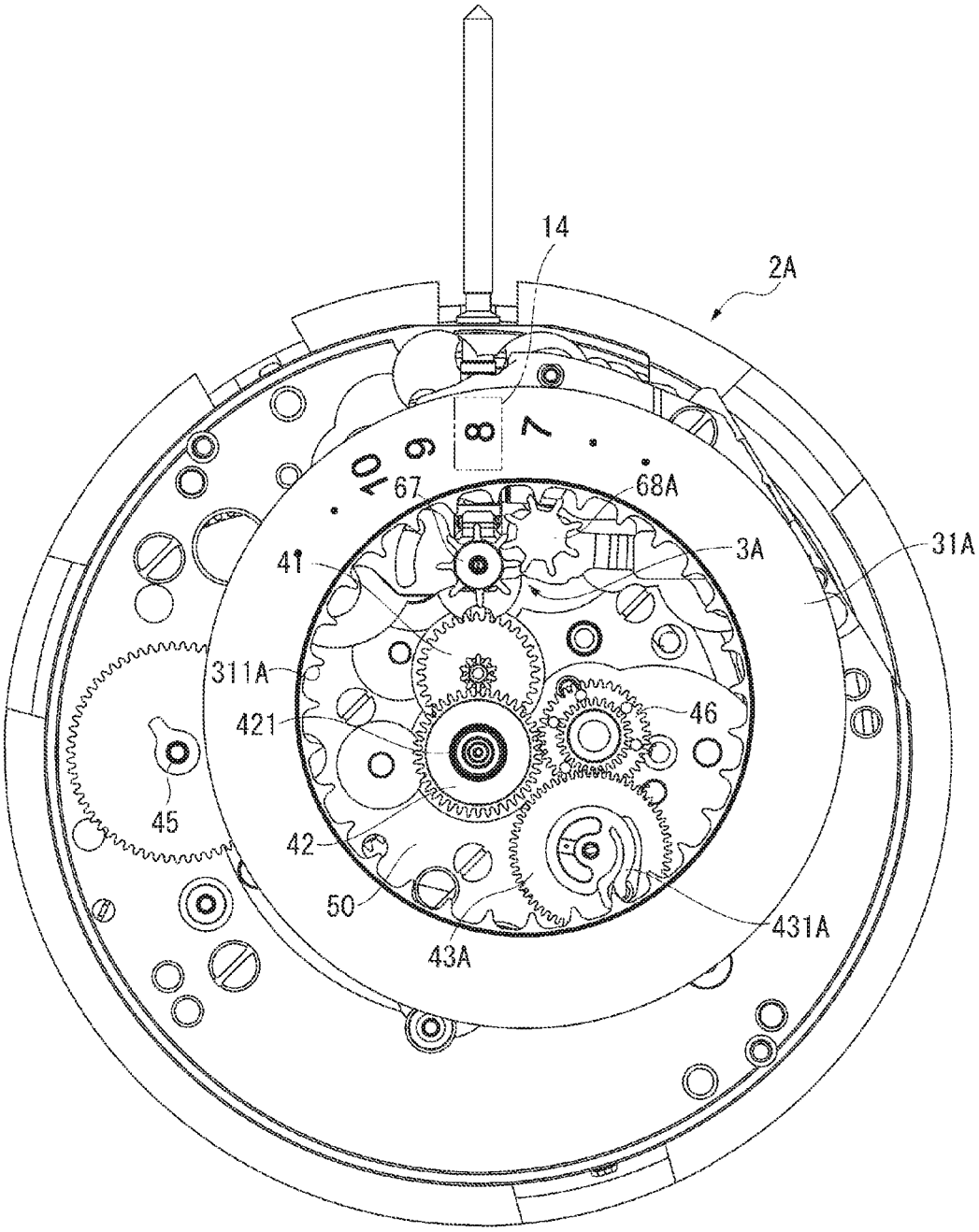
FIG. 10 is a plan view of a movement of the other timepiece.

FIG. 10 is a plan view in which a movement 2A of the timepiece 1A is viewed from the side where the dial 12 is present.

The movement 2A is provided with the date indicator 31A, which is formed in a ring shape and smaller than the date indicator 31 of the timepiece 1, as shown in FIG. 10. The date indicator 31A is a second calendar wheel according to the invention. The date indicator 31A is so disposed that the center thereof in the plan view described above is shifted from the center of the movement 2A toward the outer circumference thereof so that a shaft 45, to which the power reserve hand 24 (FIG. 9) is attached, is located in a position shifted toward the outer circumference of the movement 2A in the plan view.

On the date indicator 31A are printed inclined numerals "1" to "31" representing the date in the leftward rotation direction. An internal gear 311A, which is formed of 31 teeth, is provided along the inner circumferential edge of the day indicator 31A.

The movement 2A is provided with no day indicator or day corrector wheel.

The movement 2A is provided with an intermediate date wheel 46, which rotates in synchronization with the hour wheel 42. The movement 2A is further provided with a date indicator driving wheel 43A, which makes one rightward rotation in 24 hours in synchronization with the intermediate date wheel 46 and is smaller than the date indicator driving wheel 43 of the timepiece 1.

The date indicator driving wheel 43A includes a date finger 431A, which forwards the internal gear 311A of the date indicator 31A by one tooth per date to rotate the date indicator 31A rightward by an amount corresponding to one date. The date indicator driving wheel 43A is provided with no day finger.

In the timepiece 1A, since the calendar corrector wheel 68A is assembled into the shaft receiving hole 723 of the setting wheel lever 70, as will be described later, the crown 16 is rotated rightward to rotate the date indicator 31A rightward (clockwise) for date correction. To this end, the date indicator 31A driven by the date indicator driving wheel 43A is set to rotate rightward, which is the direction for date correction. That is, in the timepiece 1A, since the direction of rotation of the date indicator 31A driven by the date indicator driving wheel 43A is opposite the direction of rotation of the date indicator 31 of the timepiece 1, the intermediate date wheel 46 is provided between the hour wheel 42 and the date indicator driving wheel 43A to set the direction of rotation of the date indicator driving wheel 43A to be opposite the direction of rotation of the date indicator driving wheel 43 of the timepiece 1. That is, when the hour wheel 42 rotates rightward as in the case of the timepiece 1, the intermediate date wheel 46 rotates leftward, the date indicator driving wheel 43A rotates rightward, and the date indicator 31A rotates rightward.

Calendar Corrector Mechanism of Timepiece 1A

Figure 11:
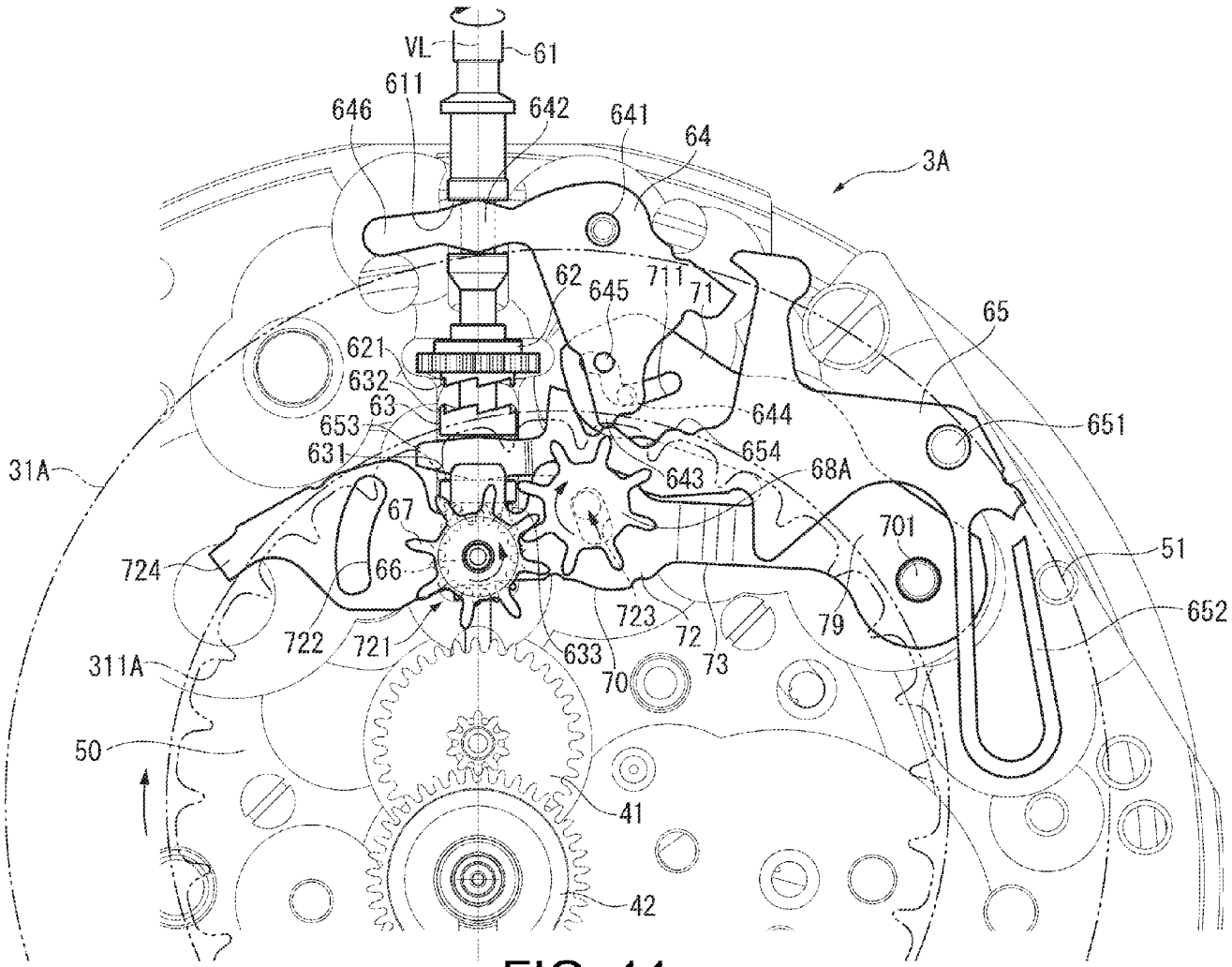
FIG. 11 shows a calendar corrector mechanism of the other timepiece in the state in which the crown is located in the first-step position (rotated rightward).

A calendar corrector mechanism 3A, with which the movement 2A is provided, will next be described. FIG. 11 shows the calendar corrector mechanism 3A with the crown 16 located in the first-step position.

In the calendar corrector mechanism 3A, the calendar corrector wheel 68A is supported by the shaft receiving hole 723 of the setting wheel lever 70, as shown in FIG. 11.

The calendar corrector wheel 68 is configured to be engageable with the same calendar correction transfer wheel 67 of the timepiece 1. In the timepiece 1A, since the date indicator 31A smaller than the date indicator 31 of the timepiece 1 is rotated, the calendar corrector wheel 68A has a smaller number of teeth and has a smaller size than the calendar corrector wheel 68 of the timepiece 1. Specifically, the number of teeth of the calendar corrector wheel 68A is fewer than that of the calendar corrector wheel 68 by one.

Further, since the calendar corrector mechanism 3A includes no day corrector wheel, it is unnecessary to restrict the engagement between the calendar corrector wheel 68A and the day corrector wheel. The calendar corrector mechanism 3A is therefore provided with no corrector lever.

The movement of the manipulator 646 of the setting lever 64 toward the dial 12 in the case where the manipulator 646 is pressed toward the dial 12 by the pressing member inserted through the through hole 52 is restricted by a restricting section provided on a platform that is not shown but fixed to the main plate 50. That is, the restriction section is provided between the setting lever 64 and the date indicator 31A and in a position where the restricting section overlaps with the through hole 52 and the manipulator 646 in the plan view described above. A corrector lever may instead be provided in the timepiece 1A, as in the timepiece 1, and a restricting section of the corrector lever may restrict the movement of the manipulator 646. In this case, since the platform needs to be provided with no restricting section, the platform does not need to undergo bending or any other processing, whereby the processing of the platform can be simplified.

Rotate Crown Rightward in First-Step Position

The action of the calendar corrector mechanism 3A in the case where the crown 16 is pulled out to the first-step position will next be described.

When the crown 16 located in the first-step position is rotated rightward, the setting wheel 66 rotates leftward, and the calendar correction transfer wheel 67 also rotates leftward integrally with the setting wheel 66, as shown in FIG. 11. The calendar corrector wheel 68A then rotates rightward in synchronization with the calendar correction transfer wheel 67.

When the calendar correction transfer wheel 67 rotates leftward, the calendar corrector wheel 68A moves in the direction toward the date indicator 31A along the shaft receiving hole 723 and meshes (engages) with the internal gear 311A of the date indicator 31A. The date indicator 31A therefore rotates rightward in synchronization with the calendar corrector wheel 68A. The date can thus be corrected.

Rotate Crown Leftward in First-Step Position

Figure 12:
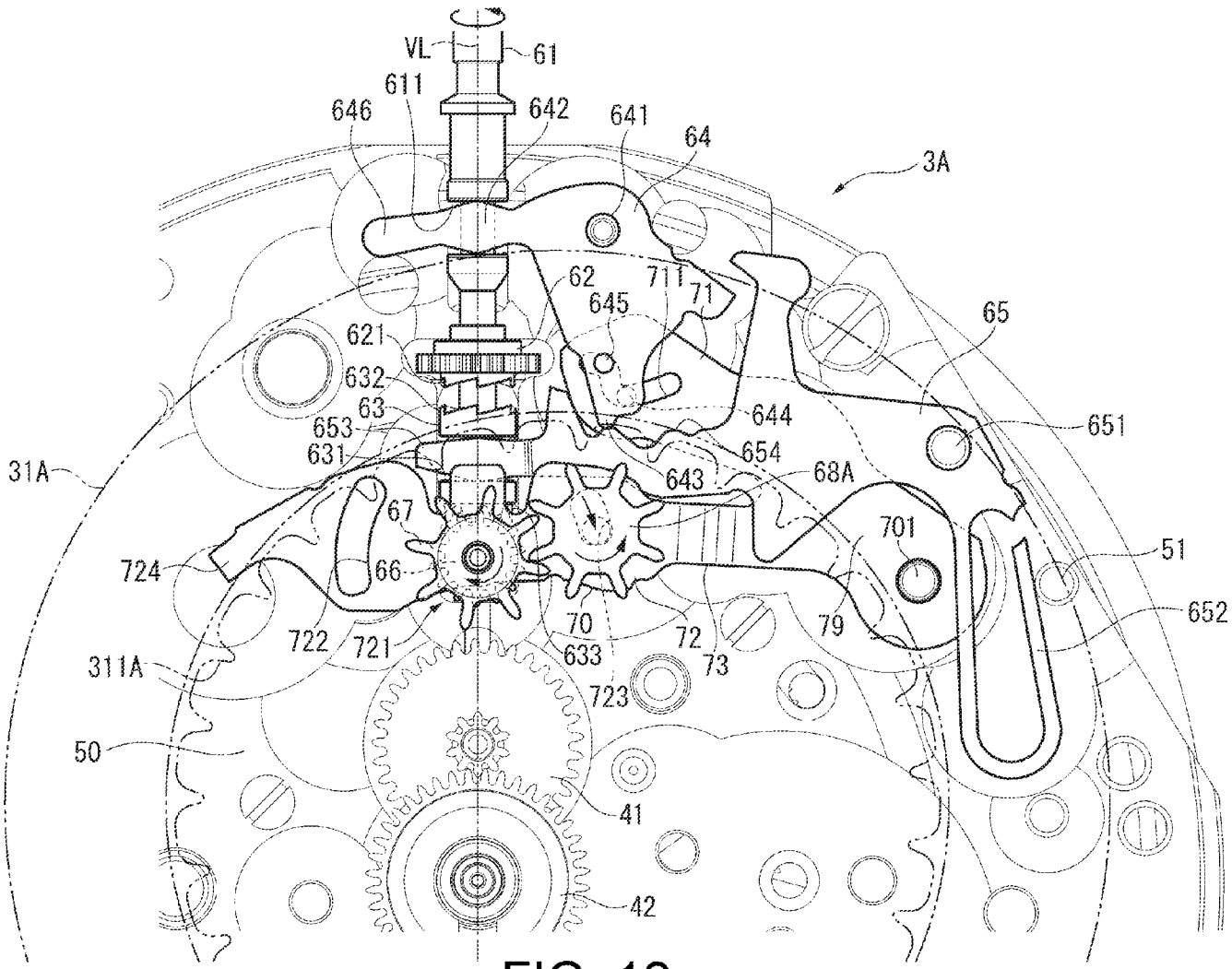
FIG. 12 shows the calendar corrector mechanism of the other timepiece in the state in which the crown is located in the first-step position (rotated leftward).

On the other hand, when the crown 16 located in the first-step position is rotated leftward, the setting wheel 66 rotates rightward, and the calendar correction transfer wheel 67 also rotates rightward integrally with the setting wheel 66, as shown in FIG. 12.

When the calendar correction transfer wheel 67 rotates rightward, the calendar corrector wheel 68A moves in the direction away from the date indicator 31A along the shaft receiving hole 723, and the calendar corrector wheel 68A separates from the date indicator 31A. The date indicator 31A therefore does not rotate.

The action of the calendar corrector mechanism 3A in the case where the crown 16 is located in the zeroth-step position and the second-step position is the same as the action in the timepiece 1. That is, in the zeroth-step position, when the crown 16 is rotated leftward, the mainspring is wound up. In the second-step position, when the crown 16 is rotated leftward, the minute hand 22 and the hour hand 23 can be rotated rightward, whereas when the crown 16 is rotated rightward, the minute hand 22 and the hour hand 23 can be rotated leftward.

Method for Manufacturing Timepiece 1 and Timepiece 1A

The timepiece 1 can be manufactured by attaching a wheel train that drives the time indicating hands 21 to 23, the date indicator driving wheel 43, the date indicator 31, the day indicator 32, the calendar corrector mechanism 3, and other components to the main plate 50 and attaching the calendar corrector wheel 68 into the shaft receiving hole 722 of the setting wheel lever 70.

On the other hand, the timepiece 1A can be manufactured by attaching the same wheel train that drives the time indicating hands 21 to 23 as that of the timepiece 1, the date indicator driving wheel 43A, the date indicator 31A, the calendar corrector mechanism 3A, and other components to the same main plate 50 as that of the timepiece 1 and attaching the calendar corrector wheel 68A into the shaft receiving hole 723 of the setting wheel lever 70.

Advantageous Effects of Embodiment

Since the timepiece 1 and the timepiece 1A use common parts, such as the main plate 50 and the calendar correction mechanism excluding the calendar corrector wheel, the timepieces can be manufactured by rearranging gears. That is, the timepiece 1 and the timepiece 1A, which differ from each other in terms of the size and position of the date indicator, can be manufactured with a small-scale design change, and the number of parts can be reduced.

In the timepiece 1, when the winding stem 61 pulled out to the first-step position is rotated leftward, the date indicator 31 rotates leftward in the same direction in which the date indicator driving wheel 43 drives the date indicator 31, whereas when the winding stem 61 is rotated rightward, the date indicator 31 does not rotate.

On the other hand, in the timepiece 1A, when the winding stem 61 pulled out to the first-step position is rotated rightward, the date indicator 31A rotates rightward in the same direction in which the date indicator driving wheel 43A drives the date indicator 31A, whereas when the winding stem 61 is rotated leftward, the date indicator 31A does not rotate. The rotation of the winding stem 61 therefore does not cause the date indicator to rotate in the direction opposite the direction in which the date indicator driving wheel drives the date indicator, whereby a situation in which the date indicator drive mechanism is broken can be avoided.

In the timepiece 1, rotating the winding stem 61 pulled out to the first-step position leftward allows rotation of the date indicator 31 for date correction. Further, rotating the winding stem 61 pulled out to the first-step position rightward allows rotation of the day indicator 32 for day correction. Since the day and date are corrected at the same time in many cases, the correction operability can be improved because both the date and day can be corrected in the state in which the winding stem 61 is pulled out to the first-step position.

In the timepiece 1 and the timepiece 1A, rotating the winding stem 61 pulled out to the first-step position allows rotation of the date indicators 31 and 31A for date correction. Further, rotating the winding stem 61 pulled out to the second-step position allows rotation of the hour hand 23 and the minute hand 22 for displayed time correction.

In the timepiece 1 and the timepiece 1A, in which the shaft 701 of the setting wheel lever 70 is located between the first vertical line L1 and the second vertical Line L2, the axis around which the setting wheel 66 rotates when the setting wheel lever 70 is located in the first movement position and the axis around which the setting wheel 66 rotates when the setting wheel lever 70 is located in the second movement position can be set roughly on the straight line VL.

The clutch wheel 63, the setting wheel 66, and the minute wheel 41 can therefore be arranged roughly along the straight line VL, whereby the clutch wheel 63, the setting wheel 66, and the minute wheel 41 are allowed to engage with each other in a well-balanced manner.

Further, since the shaft 701 of the setting wheel lever 70 is provided in a position where it overlaps with the date indicators 31 and 31A, the distances from the shaft 701 to the shaft receiving hole 722 and the shaft receiving hole 723 can be longer than in a case where the shaft 701 is provided inside the inner circumference of the date indicators 31 and 31A.

Therefore, even in the timepiece 1A, in which the calendar correction wheel is provided in a position shifted toward the shaft 701 with respect to the calendar correction transfer wheel, the calendar corrector wheel 68A is allowed to travel by a predetermined length when the winding stem 61 is pulled out from the first-step position to the second-step position for separation between the calendar corrector wheel 68A and the date indicator 31A.

In the timepiece 1 and the timepiece 1A, in the case where the winding stem 61 is located in the zeroth-step position, when the pressing member is inserted through the though hole 52 from the side where the case back is present, and the manipulator 646 of the setting lever 64 is pushed by the pressing member toward the front side of the timepiece, the setting lever 64 inclines, whereby the engagement between the winding stem 61 and the setting lever 64 can be released.

When the engagement between the winding stem 61 and the setting lever 64 is released, the user does not feel the clicking sensation felt by the user when the user pulls out the crown 16. The user cannot therefore be aware of the disengagement. It is therefore conceivable that the user presses the pressing member deeper. In this case, when the manipulator 646 of the setting lever 64 pressed by the pressing member moves to the position of the restricting section 93 of the corrector lever 90 or the position of the restricting section of the platform, the manipulator 646 comes into contact with the restricting section, which does not allow further movement of the manipulator 646. The restricting section thus prevents the setting lever 64 from coming into contact with the date indicator and therefore prevents deformation of the date indicator.

Further, since the movement of the manipulator 646 toward the dial 12 is restricted by the restricting section, the force applied by the pressing member to the manipulator 646, the travel over which the pressing member is pushed (pressing stroke), and other conditions can be set to the same values in timepieces having different specifications.

Further, when the winding stem 61 is pulled out in the axial direction thereof and located in the first-step position or the second-step position, the restricting section overlaps with the through hole 52 in the plan view described above. Therefore, in the case where the winding stem 61 is located in the first-step position or the second-step position and the pressing member is inserted through the through hole 52, when the pressing member moves to the position of the restricting section, the pressing member comes into contact with the restricting section, which restricts further movement of the pressing member. The restricting section thus prevents the pressing member from coming into contact with the date indicator and therefore prevents deformation of the date indicator.

In the case where the winding stem 61 is located in the normal zeroth-step position, the engagement between the winding stem 61 and the setting lever 64 can be released. That is, since the engagement can be released without pulling out the winding stem 61, whereby the disengagement task can be simplified.

In the case where the winding stem 61 is located in a position other than the zeroth-step position (first-step position or second-step position), the setting lever 64 and the corrector ever 90 do not overlap with each other in the plan view described above. Therefore, to assemble the timepiece in the state in which the winding stem 61 is pulled out to the first-step position or the second-step position, the setting lever 64 can be attached to the main plate 50 and assembled even after the corrector lever 90 has been assembled, whereby the flexibility of the assembly can be improved.

In the timepiece 1 and the timepiece 1A, since the corrector lever 90 and the platform form a restricting member that restricts the movement of the setting lever 64 toward the dial 12, no separate restricting member needs to be provided, whereby the number of parts can be reduced.

Since the movement of the manipulator 646 toward the dial 12 is restricted by the restricting section, the force applied by the setting lever pressing section 82 of the setting lever jumper 80 to the setting lever 64 toward the main plate 50 can be set to be smaller than, for example, in a case where the setting lever pressing section 82 restricts the movement of the manipulator 646 toward the dial 12. As a result, the burden on the user who moves the winding stem 61 in the axial direction thereof can be reduced, whereby operation feeling (clicking sensation) can be improved.

The manipulator 646 of the setting lever 64 is provided on the side opposite the shaft 641 with respect to the winding stem 61. Therefore, when the pressing member presses the manipulator 646, the setting lever 64 inclines around points, as fulcrums, in the vicinity of the shaft 641, the front end section 643, and the protruding pin 644. Since movement of the front end section 643 and the protruding pin 644 toward the dial 12 is thus restricted, a situation in which the engagement between the setting lever 64 and the yoke 65 and the engagement between the setting lever 64 and the setting wheel lever 70 are released can be avoided.

When the pressing member is operated manually (by using human force) to press the manipulator 646, it is conceivable that the manipulator 646 is pressed with unnecessarily large force.

In the timepiece 1, since the corrector lever 90 is attached to the main plate 50 with the screw 902, which is made of steel, a situation in which the corrector lever 90 falls off the main plate 50 even when the manipulator 646 is pressed with large force and comes into contact with the restricting section can be avoided.

In the timepiece 1, the restricting section 93 of the correction lever 90, which operates in synchronization with the winding stem 61, restricts the movement of the manipulator 646 of the setting lever 64 toward the dial 12.

The corrector lever 90 is a swingable member that swings in synchronization with the winding stem 61 and is disposed in the vicinity of the setting lever 64, which also swings in synchronization with the winding stem 61. Therefore, the corrector lever 90 can be relatively readily so designed that the corrector lever 90 is provided with the restricting section 93, which overlaps with the manipulator 646 in the plan view described above, and that the screw 902, which attaches the corrector lever 90 to the main plate 50, is disposed in the vicinity of the restricting section 93 in order to provide rigidity that allows restriction of the movement of the manipulator 646. Therefore, the restricting section that can restrict the movement of the manipulator 646 can be provided with a small-scale design change as compared, for example, with a case where the platform is provided with the restricting section, as in the timepiece 1A.

Other Embodiments

The invention is not limited to the embodiment described above, and changes, improvements, and other modifications to the extent that the advantage of some aspects of the invention is achieved fall within the scope of the invention.

In the embodiment described above, one of the shaft receiving hole 722 and the shaft receiving hole 723 of the setting wheel lever 70 is chosen in accordance with the size of the date indicator, and the calendar corrector wheel is attached into the chosen shaft receiving hole, but the invention is not necessarily configured this way. For example, one of the shaft receiving hole 722 and the shaft receiving hole 723 maybe chosen in accordance with the direction in which the date indicator rotates, and the calendar corrector wheel may be attached into the chosen shaft receiving hole. In this case, timepieces in which the date indicators rotate in different directions can be manufactured with a small-scale design change.

For example, when the calendar small window is located in the 3-o'clock position of the timepiece, the calendar corrector wheel is attached into the shaft receiving hole 723 and the date indicator is set to rotate rightward so that the numerals visible through the calendar small window move downward. When the calendar small window is located in the 9-o'clock position of the timepiece, the calendar corrector wheel is attached into the shaft receiving hole 722 and the date indicator is set to rotate leftward so that the numerals displayed through the calendar small window move downward. Exterior appearance and correction feeling at the time of calendar correction can thus be improved.

In the embodiment described above, the calendar small window 14 is provided in the 3-o'clock position of the timepiece, but the invention is not necessarily configured this way. For example, the calendar small window 14 maybe provided in the 6-o'clock position, the 9-o'clock position, or the 12-o'clock position. The calendar small window 14 may instead be provided inside the outer circumference of the dial 12.

In the embodiment described above, the timepiece 1 and the timepiece 1A differ from each other in terms of the number of teeth of the calendar corrector wheel and the size thereof, but the invention is not necessarily configured this way.

For example, when the timepiece 1 and the timepiece 1A have date indicators of the same size, calendar corrector wheels having the same number of teeth and the same size may be used.

In the embodiment described above, the calendar wheel in the embodiment of the invention is formed of the date indicator, but the invention is not necessarily configured this way. For example, the calendar wheel in the embodiment of the invention may instead be formed, for example, of a month indicator that displays the month or a day indicator.

In the embodiment described above, each of the shaft receiving hole 722 and the shaft receiving hole 723 is formed of an elongated hole, but the invention is not necessarily configured this way. For example, when the day does not need to be corrected, and the date indicator is rotatable in the direction opposite the direction in which the date indicator driving wheel drives the date indicator, each of the shaft receiving hole 722 and the shaft receiving hole 723 may be formed of a circular hole.

In the embodiment described above, the timepiece 1A includes no day indicator or day corrector wheel, but the invention is not necessarily configured this way. That is, the timepiece 1A may include a day indicator and a day corrector wheel. In this case, the timepiece 1A only needs to have a structure in which the calendar corrector wheel 68A meshes with the day corrector wheel when the crown 16 pulled out to the first-step position is rotated leftward.

Further, in the embodiment described above, the timepiece 1 includes the day indicator 32 and the day corrector wheel 69, but the invention is not necessarily configured this way. That is, the timepiece 1 may not include the day indicator 32 or the day corrector wheel 69.

In the embodiment described above, the shaft 701 of the setting wheel lever 70 is located between the first vertical line L1 and the second vertical line L2, but the invention is not necessarily configured this way. That is, the shaft 701 may not be located between the first vertical line L1 and the second vertical line L2.

Further, in the embodiment described above, the shaft 701 of the setting wheel lever 70 overlaps with the date indicators 31 and 31A in the plan view described above, but the invention is not necessarily configured this way. For example, when the setting wheel lever 70 swings over a relatively wide angular range, the shaft 701 may be disposed inside the inner circumference of the date indicators 31 and 31A.

In the embodiment described above, each of the timepiece 1 and the timepiece 1A has a drive source formed of a mainspring, but the invention is not necessarily configured this way. For example, the drive source may instead be a motor driven with electric power supplied from a battery.

In the embodiment described above, the restricting sections of the timepiece 1 and the timepiece 1A are part of the correction lever 90 and the platform, respectively, but the invention is not necessarily configured this way. For example, each of the restricting sections may instead be part of a dedicated component.

Further, in the embodiment described above, the manipulator 646 of the setting lever 64 pressed by the pressing member comes into contact with the restricting section described above, so that the manipulator 646 is not allowed to come into contact with the date indicator, but the invention is not necessarily configured this way. For example, the manipulator 646 may not be allowed to come into contact with the date indicator by allowing a portion of the setting lever 64 other than the manipulator 646 to come into contact with the restricting section described above.

In the embodiment described above, in the timepiece 1, when the crown 16 is located in the zeroth-step position, the manipulator 646 of the setting lever 64 overlaps with the through hole 52, whereas when the crown 16 is located in the first-step position or the second-step position, the manipulator 646 does not overlap with the through hole 52, but the invention is not necessarily configured this way. For example, when the crown 16 is located in the first-step position, the manipulator 646 may overlap with the through hole 52, whereas when the crown 16 is located in the zeroth-step position or the second-step position, the manipulator 646 may not overlap with the through hole 52. Instead, when the crown 16 is located in the second-step position, the manipulator 646 may overlap with the through hole 52, whereas when the crown 16 is located in the zeroth-step position or the first-step position, the manipulator 646 may not overlap with the through hole 52. Still instead, when the crown 16 is located in any of the zeroth-step position, the first-step position, and the second-step position, the manipulator 646 may overlap with the through hole 52.

The entire disclosure of Japanese Patent Application No. 2015-087810, filed Apr. 22, 2015 is expressly incorporated by reference herein.

What is claimed is:

1. A timepiece comprising:

a winding stem that is allowed to be pulled out to a first position in an axial direction of the winding stem;

a calendar correction transfer wheel that rotates in synchronization with the winding stem in a state in which the winding stem is pulled out to the first position;

a calendar corrector wheel that rotates in synchronization with the calendar correction transfer wheel;

a setting wheel lever that supports the calendar correction transfer wheel and the calendar corrector wheel; and a calendar wheel that rotates in synchronization with the calendar corrector wheel, wherein the setting wheel lever is provided with a first attachment section and a second attachment section, to which the calendar corrector wheel is attachable in a rotatable manner, and the calendar corrector wheel is attached to one of the first attachment section and the second attachment section in accordance with a type of the calendar wheel.

2. The timepiece according to claim 1, wherein the first attachment section and the second attachment section are so provided as to sandwich the calendar correction transfer wheel, formed along an arc concentric with the calendar correction transfer wheel, and each formed of an elongated hole having one end along the arc closer to the calendar wheel than another end of the elongated hole, the calendar corrector wheel, when attached to the first attachment section, moves in a direction toward the calendar wheel along the elongated hole as the first attachment section and engages with the calendar wheel when the calendar correction transfer wheel rotates in a first direction so as to rotate the calendar wheel in a second direction that is opposite the first direction, and moves in a direction away from the calendar wheel along the elongated hole as the first attachment section and separates from the calendar wheel when the calendar correction transfer wheel rotates in the second direction, whereas when attached to the second attachment section, moves in the direction toward the calendar wheel along the elongated hole as the second attachment section and engages with the calendar wheel when the calendar correction transfer wheel rotates in the second direction so as to rotate the calendar wheel in the first direction, and moves in the direction away from the calendar wheel along the elongated hole as the second attachment section and separates from the calendar wheel when the calendar correction transfer wheel rotates in the first direction.

3. The timepiece according to claim 2, further comprising:

a day corrector wheel engageable with the calendar corrector wheel; and a day indicator that rotates in synchronization with the day corrector wheel, wherein the calendar corrector wheel is attached to the first attachment section, and when the calendar correction transfer wheel rotates in the second direction, the calendar corrector wheel moves in the direction away from the calendar wheel along the elongated hole as the first attachment section and engages with the day corrector wheel.

4. The timepiece according to claim 1, further comprising:

a clutch wheel that rotates integrally with the winding stem;

a setting wheel that is supported by the setting wheel lever and rotates in synchronization with the clutch wheel and integrally with the calendar correction transfer wheel; and a minute wheel engageable with the setting wheel, wherein the winding stem is allowed to be pulled out to a second position in the axial direction of the winding stem, the setting wheel lever includes a swing shaft along a thickness direction of the timepiece, swings around the swing shaft in synchronization with the axial movement of the winding stem, and is located in a first movement position when the winding stem is pulled out to the first position, whereas located in a second movement position when the winding stem is pulled out to the second position, and when the setting wheel lever is located in the first movement position, the calendar corrector wheel is engageable with the calendar wheel, and the setting wheel is separate from the minute wheel, whereas when the setting wheel lever is located in the second movement position, the calendar corrector wheel is separate from the calendar wheel, and the setting wheel engages with the minute wheel.

5. The timepiece according to claim 4, wherein the swing shaft of the setting wheel lever interests a straight line passing through an axis of the winding stem at right angles, is positioned between a first vertical line that passes through an axis of rotation of the setting wheel in the case where the setting wheel lever is located in the first movement position and a second vertical line that intersects the straight line passing through the axis of the winding stem at right angles and passes through the axis of rotation of the setting wheel in the case where the setting wheel lever is located in the second movement position, and is located in a position where the swing shaft overlaps with the calendar wheel.

6. The timepiece according to claim 1, wherein the type of the calendar wheel includes a first calendar wheel and a second calendar wheel different from each other in terms of size, and when the timepiece includes the first calendar wheel, the calendar corrector wheel corresponding to the first calendar wheel is attached to the first attachment section, whereas when the timepiece includes the second calendar wheel, the calendar corrector wheel corresponding to the second calendar wheel is attached to the second attachment section.

7. A method for manufacturing a timepiece including a winding stem that is allowed to be pulled out to a first position in an axial direction of the winding stem, a calendar correction transfer wheel that rotates in synchronization with the winding stem in a state in which the winding stem is pulled out to the first position, a calendar corrector wheel that rotates in synchronization with the calendar correction transfer wheel, a setting wheel lever that supports the calendar corrector wheel, and a calendar wheel that rotates in synchronization with the calendar corrector wheel, the setting wheel lever provided with a first attachment section and a second attachment section, to which the calendar corrector wheel is attachable in a rotatable manner, the method comprising attaching the calendar corrector wheel to one of the first attachment section and the second attachment section in accordance with a type of the calendar wheel.

* * * * *